US008207711B2

(12) United States Patent
Crawford et al.

(10) Patent No.: US 8,207,711 B2
(45) Date of Patent: Jun. 26, 2012

(54) BIPHASE LASER DIODE DRIVER AND METHOD

(75) Inventors: Ian D. Crawford, Longwood, FL (US); Jeffrey T. Richter, Longwood, FL (US); Steven L. Pickles, Sanford, FL (US); John A. Harwick, Sanford, FL (US)

(73) Assignee: Analog Modules, Inc., Longwood, FL (US)

( * ) Notice: Subject to any disclaimer, the term of this patent is extended or adjusted under 35 U.S.C. 154(b) by 440 days.

(21) Appl. No.: 12/541,915

(22) Filed: Aug. 15, 2009

(65) Prior Publication Data

US 2010/0207543 A1 Aug. 19, 2010

Related U.S. Application Data

(60) Provisional application No. 61/089,051, filed on Aug. 15, 2008.

(51) Int. Cl.
*G05F 1/70* (2006.01)

(52) U.S. Cl. ..... 323/207; 323/272; 323/282; 327/231; 327/233; 315/291; 315/294

(58) Field of Classification Search ..... 363/17, 363/21.06; 315/291, 294; 323/207, 272, 323/282; 327/231, 233, 115
See application file for complete search history.

(56) References Cited

U.S. PATENT DOCUMENTS

| | | | |
|---|---|---|---|
| 4,114,051 | A | 9/1978 | Curtice |
| 4,161,023 | A | 7/1979 | Goffeau |
| 4,298,869 | A | 11/1981 | Okuno |
| 4,323,845 | A | 4/1982 | Leach |
| 4,472,807 | A | 9/1984 | Chubb et al. |
| 4,673,865 | A | 6/1987 | DeLuca et al. |
| 4,720,668 | A | 1/1988 | Lee et al. |
| 4,723,312 | A | 2/1988 | Yamashita et al. |
| 4,745,610 | A | 5/1988 | Yoshikawa |
| 4,751,524 | A | 6/1988 | Balchunas |
| 4,807,239 | A | 2/1989 | Takano et al. |

(Continued)

FOREIGN PATENT DOCUMENTS

| | | |
|---|---|---|
| EP | 0553867 | 8/1993 |

(Continued)

OTHER PUBLICATIONS

Data Sheet, Model 778 Pulsed High current Laser Driver, Analog Modules, Inc., Longwood, Florida, Nov. 1995.

(Continued)

*Primary Examiner* — Vibol Tan
(74) *Attorney, Agent, or Firm* — Gerald E. Linden

(57) ABSTRACT

A current-driven load such as LEDs or laser diodes is driven by a current driver having a two stages (or phases), the summed outputs of which have ripple which is forced to be out-of-phase with one another. In analog embodiments, an output (ripple or switching) of a master stage hysteresis controller is phase-shifted and scaled, and modulates the input of a slave stage hysteresis controller so that the slave stage pulls into a ripple-canceling phase. In a digital embodiment, a faster of the two phases is designated "master", maximum and minimum thresholds are set, and the slave phase's on time is based on a previous cycle's slave phase ON time, the master stage OFF time and an offset. The slave controller preferentially "locks" to the anti-phase of the master stage (or phase) and the ripple current at the summed output substantially cancels.

18 Claims, 8 Drawing Sheets

U.S. PATENT DOCUMENTS

| | | | | |
|---|---|---|---|---|
| 5,140,175 | A | 8/1992 | Yagi et al. | |
| 5,182,756 | A | 1/1993 | Waki et al. | |
| 5,287,372 | A | 2/1994 | Ortiz | |
| 5,291,505 | A | 3/1994 | Nielson | |
| 5,315,606 | A | 5/1994 | Tanaka | |
| 5,349,595 | A | 9/1994 | Ogawa et al. | |
| 5,394,415 | A | 2/1995 | Zucker et al. | |
| 5,491,491 | A | 2/1996 | Lebby et al. | |
| 5,652,767 | A | 7/1997 | Kiyonaga et al. | |
| 5,661,645 | A | 8/1997 | Hochstein | |
| 5,736,881 | A | 4/1998 | Ortiz | |
| 5,841,648 | A | 11/1998 | Mansfield | |
| 5,936,599 | A | 8/1999 | Reymond | |
| 5,966,394 | A | 10/1999 | Spurr et al. | |
| 6,369,525 | B1 | 4/2002 | Chang et al. | |
| 6,411,045 | B1 | 6/2002 | Nerone | |
| 6,430,064 | B1 | 8/2002 | Tsuchimoto et al. | |
| 6,466,188 | B1 | 10/2002 | Cato | |
| 6,587,490 | B2 | 7/2003 | Crawford | |
| 6,697,402 | B2 | 2/2004 | Crawford | |
| 6,853,150 | B2 | 2/2005 | Clauberg et al. | |
| 6,856,119 | B2 * | 2/2005 | Crawford | 320/166 |
| 7,107,468 | B2 | 9/2006 | Pullen et al. | |
| 7,348,948 | B2 | 3/2008 | Crawford et al. | |
| 2005/0185428 | A1 * | 8/2005 | Crawford et al. | 363/21.06 |
| 2010/0127671 | A1 * | 5/2010 | Lidstrom | 323/207 |

FOREIGN PATENT DOCUMENTS

| | | |
|---|---|---|
| EP | 0567280 | 10/1993 |
| EP | 0597644 | 5/1994 |
| GB | 1543722 | 4/1979 |

OTHER PUBLICATIONS

Application Bulletin AB-12, Insight into Inductor Current, Fairchild Semiconductor Jul. 21, 1998.

Designing with hysteretic current-mode control, Levin and O'Malley, Cherry Semiconductor Corp., EDN Access, Apr. 28, 1994.

Data Sheet, MAX4376 Single/Dual/Quad, High Side Current-Sense Amplifiers with Internal Gain, Maxim Integrated Products, Dallas Semiconductor, 19-1781; Rev 3: May 2004, 9 pages.

"GaAs MESFET Laser-Driver for 1.7 Gbit/s Lightwave Transmitter", F. S. Chen et al., Journal of Lightwave Technology. vol. 6. No. 3. Mar. 1988.

Data Sheet, SMT PowerInductors-SER2800 Series, Coilcraft, Cary, Illinois, Document 490-1, Aug. 22, 2008.

Data Sheet, LTC4442/LTC4442-1, High Speed Synchronous N-channel MOSFET Drivers, Linear Technology, Linear Technologies, 12pp.

Buck Converter, Wikipedia, 13 pages.

Switching Regulators, National Semiconductor Corporation, pp. 30-62.

Application note AN1197.1, ISL6310EVAL1Z: Two Phase Buck Converter with Integrated High Current 5V to 12V Drivers, Intersil, © 2005-2006, pp. 1-20.

How Does a Buck Regulator Work?, Ask Control Engineering, Mar. 31, 2008.

Data Sheet, UC1710, UC2710, UC3710 High Current FET Driver, Unitrode, May 1999.

Data Sheet, MIC4416/4417, IttyBitty™ Low Side MOSFET Driver, Micrel, May 2005.

Data Sheet, LMV7219—7 nsec 2.7V to 5V Comparator with Rail-to-Rail Output, National Semiconductor, Aug. 11, 2009.

Data Sheet, IRF6646 DirectFET™ Power MOSFET, International Rectifier, Nov. 4, 2005.

Data Sheet, ProASIC3 Flash Family FPGAs, Actel Corporation, May 2007.

Data Sheet, STPS15H100C High voltage power Shottky rectifier, ST Microelectronics, Jun. 2006.

Data Sheet, IHLP5050-EZ-01, Low Profile, High Current HLP Inductors, Vishay Dale, Jun. 2, 2009.

* cited by examiner

BIPHASE LASER DIODE DRIVER AND METHOD

CROSS-REFERENCE TO RELATED APPLICATIONS

Priority is claimed from U.S. Provisional Application No. 61089051 filed 15 Aug. 2008.

TECHNICAL FIELD

The invention relates to current drivers, such as diode drivers that provide a constant, controlled, pulsed, or variable current into a current-driven device, such as a light emitting diode (LED) or array of light-emitting diodes, including laser diodes.

BACKGROUND

High current laser diodes may be used for applications such as laser pumping and illumination. High current light emitting diodes (LEDs) may be used for applications such as general illumination, medical light sources, laboratory instruments.

Analog constant current sources or pulsed analog constant current sources using linear dissipative pass elements have been used as diode drivers to power light emitting diodes, often laser diodes. An array of LEDs (or diode array) are connected to a power source. A linear control (pass) element is disposed in the path between the LED array and the power source. Current flowing through the LEDs flows through a current sense resistor which supplies a voltage indicative of current to an input of an error amplifier, the other input of which receives a reference demand voltage indicative of the desired current. The output of the amplifier controls the linear control element to maintain a constant current through the LEDs. This is a simple, straightforward analog control loop. Such analog current sources are inefficient due to power (e.g., heat) dissipation in the linear pass element controlling the current. (See, e.g., FIG. 1 of U.S. Pat. No. 7,348,948, incorporated by reference herein.) An example of a linear pass element current source is the Model 778 Pulsed High Current Laser Diode Driver (Analog Modules, Inc., Longwood, Fla.). The 778 Series laser diode drivers are designed to power high current laser diodes, and may be used for pulsed or continuous wave (CW) LED or laser diode current source. Output currents of 1-100 A are available.

For pulsed laser or LED sources, the energy is typically stored in a capacitor to minimize a sudden lossy power demand from the prime power source. With a linear current regulator, the regulator pass element must remain in the linear region during the discharge of the energy storage capacitor to regulate the pulse of current. To minimize the voltage initially across this pass element, and hence dissipation, the capacitor must have a small value of voltage droop during this current draw, requiring a large amount of stored energy and a large capacitance value.

FIGS. 6A and 6B illustrate a buck converter of the prior art comprising a DC power supply "P", a switch "S", an inductor "L", a load "R" and a diode "D", connected as shown. The switch "S" may be a FET, and the load "R" may be a laser diode. The load "R" is grounded. The diode "D" is connected as a flyback, or freewheeling diode, via the load "R", across the inductor "L".

In FIG. 6A, the switch "S" is closed, and current flows through the inductor "L" and through the load "R", but not through the diode "D", as shown by the dashed-line arrow. In FIG. 6B, the switch "S" is opened, and current continues to flow through the inductor "L", through the load "R", and through the diode "D", as shown by the dashed-line arrow.

FIGS. 7A and 7B a buck converter of the prior art comprising a DC power supply "P", a switch "S", an inductor "L", a load "R" and a diode "D", connected as shown. The switch "S" may be a FET, and the load "R" may be a laser diode. The load "R" is not grounded. The diode "D" is connected as a flyback, or freewheeling diode, via the load "R", across the inductor "L".

In FIG. 7A, the switch "S" is closed, and current flows through the load "R" and through the inductor "L", but not through the diode "D", as shown by the dashed-line arrow. In FIG. 7B, the switch "S" is opened, and current continues to flow through the load "R", through the inductor "L", and through the diode "D", as shown by the dashed-line arrow.

In both of the examples given above, the buck converter operates asynchronously. By replacing the diode "D" with a (second) switch, operation may be made synchronous.

U.S. Pat. No. 5,287,372 ("Ortiz") discloses a quasi-resonant diode drive current source that provides high power pulsed current that drives light emitting diodes, and the like. The pulsed output current of the quasi-resonant diode drive current source is sensed, and is regulated by a control loop to a level required by the light emitting diodes. In a specific embodiment of the invention, a zero-current-switched full wave quasi-resonant buck converter is described that provides a high amplitude pulsed output current required to drive light emitting pump diodes used in a solid state diode pumped laser. The use of a quasi-resonant converter as a pulsed current source provides a much higher conversion efficiency than conventional laser current sources. This higher efficiency results in less input power drawn from a power source and cooler operation, resulting in a higher reliability current source.

U.S. Pat. No. 5,736,881 (Ortiz), discloses a diode drive current source that uses a regulated constant current power source to supply current to drive a load, and the load current is controlled by shunt switches. If a plurality of loads utilize less than 50% duty factor, then one current source can drive N multiple dissimilar impedance loads, each at 100%/N duty factor. The current source includes a power converter coupled between the power source and the load(s) for providing pulsed current thereto. A current sensor is provided for sensing current flowing through the loads. A controller is coupled between the sensor and the power converter for regulating the amplitude of the output current supplied to the loads. A shunt switch is coupled across the loads, and a duty factor controller is coupled to the shunt switch for setting the duty factor of the shunt switch. A laser drive circuit, or driving light emitting diode arrays is also disclosed that include a plurality of the current sources. Alternatively, if the duty factor is sufficiently low, one current source may be used to drive a plurality of arrays.

U.S. Pat. No. 7,348,948 ("Crawford"), teaches a polyphase diode driver using multiple stages to generate a controlled current to the load. This approach may be efficient and have many advantages for military use, but may be somewhat complex for low cost commercial applications. More particularly, > A driver supplying a total current to a load has a plurality (n) of driver stages (ST1 . . . STn). One stage is a master stage. Each driver stage has a switching device (Q) and an inductor (L) connected in series between the switching device and the output of the driver stage. The switching devices are turned ON in sequence with one another, during a cycle time (Tc) which is determined by sensing current through the inductor (L1) in the master stage. When the switching device is turned ON current through the inductor rises, when the inductor current reaches the value of a demanded current the switch is turned OFF, and after the switch is turned OFF the inductor continues to supply (output) current to the load with a current which ramps down. A rectifying device (D) connected between the inductor and the supply line allows current to continue to flow in the inductor and be supplied to the load after the switch is turned OFF.

U.S. Pat. No. 7,107,468, incorporated by reference herein, discloses a plurality of constant ON-time buck converters coupled to a common load. The output of each buck converter is coupled to a common load via a series sense resistor. The regulated output voltage across the common load is compared to a reference voltage to generate a start signal. The start signal is alternately coupled to the controller on each buck converter. The ON-time of a master buck converter is terminated when a ramp signal generated from the regulator input voltage exceeds the reference voltage. All other slave converters have an ON-time pulse started by the start signal and stopped by comparing a sense voltage corresponding to their output current during their ON-time pulse to the peak current in the master converter during its ON-time. A counting circuit with an output corresponding to each of the plurality of buck converters is used to select which buck converter receives the start signal. More particularly . . .

FIG. 1A is a simplified block diagram of a dual phase buck regulator with constant ON-time control and active current sharing. The output capacitor (C) 102 is usually a network of many capacitors in parallel. The equivalent series resistance (ESR) represented by resistor ESR 101 is the effective series resistance of this capacitor network. ESR 101 is the real part of the complex impedance of the network of parallel capacitors making up C 102. Two sense resistors, R 137 and R 103, provide voltages VR2 127 and VR1 122 that are proportional to the current in inductors 117 and 104 in each phase, respectively. VR1 122 is the difference in potential between node 124 and Vout 130 and VR2 127 is the difference between node 131 and Vout 130. The four field effect transistors (FETs), FET 106, FET 107, FET 116, and FET 118 control the duty cycle of each phase. Diodes 105 and 115 are flyback diodes that insure the currents in the inductors 104 and 117, respectively, are not interrupted. The gate drivers 119 and 120 in phase drive circuits 180 and 181 interface with the control circuit 121 and provide the voltages needed to drive FETs 106, 107, 116 and 118. The control circuit 121 determines which of the two phases, 180 or 181, to turn ON when the output voltage (Vout) 130 falls below the reference voltage (Vref) 123. The output currents IL1 141 and 1L2 142 combine to provide load current 1out 160 to load 140.

FIG. 1B illustrates the timing of two converter phases 180 and 181. The two graphs in FIG. 1B show that by complementary switching the two converter phases 180 and 181, both the amplitudes of the output current ripple (Iout 160) relative to output currents IL1 141 and IL2 142 and output voltage ripple (Vout 130) relative to sense voltages VR1 127 and VR2 122 are cut in half and the ripple frequency is doubled.

GLOSSARY & DEFINITIONS

Unless otherwise noted, or as may be evident from the context of their usage, any terms, abbreviations, acronyms or scientific symbols and notations used herein are to be given their ordinary meaning in the technical discipline to which the disclosure most nearly pertains. The following terms, abbreviations and acronyms may be used throughout the descriptions presented herein and should generally be given the following meaning unless contradicted or elaborated upon by other descriptions set forth herein. Some of the terms set forth below may be registered trademarks (®).

buck A "buck regulator" or "buck converter" is a DC-to-DC step-down power regulator supply utilizing the fact that inductors react to electric current fluctuations in such a way as to keep current flowing through them constant. The buck converter circuit makes use of back EMF (collapse of the magnetic field) to keep current flowing after the electricity source has been disconnected.

comparator In electronics, a comparator is a device which compares two voltages or currents, and switches its output to indicate which is larger. More generally, the term is also used to refer to a device that compares two items of data.

DC short for direct current. DC is electrical current that flows in one direction, such as from a normal flashlight battery. It's counterpart, AC (alternating current) is current that alternately flows in one direction, then in the other direction, such as normal household current. Both AC and DC currents will have a "voltage", and AC current will also have a frequency that it switches back and forth. DC current does not have a frequency, because it does not switch back and forth, but there can be "ripple", or some unsteadiness in its voltage level.

differential A differential amplifier is a type of electronic amplifier that multiplies the amplifier difference between two inputs by some constant factor (the differential gain). Many electronic devices use differential amplifiers internally.

duty cycle In electronics, the duty cycle is the fraction of time that a system is in an "active" state. For example, in an ideal pulse train (one having rectangular pulses), the duty cycle is the pulse duration divided by the pulse period. For a pulse train in which the pulse duration is 1 μs and the pulse period is 4 μs, the duty cycle is 0.25. The duty cycle of a square wave is 0.5, or 50%.

flyback diode A "flyback" diode (sometimes called a snubber diode, freewheeling diode, suppressor diode, or catch diode) is a diode used to eliminate flyback, the sudden voltage spike seen across an inductive load when its supply voltage is suddenly reduced or removed.

FPGA short for field-programmable gate array. A FPGA is a semiconductor device that can be configured by the customer or designer after manufacturing—hence the name "field-programmable". FPGAs are programmed using a logic circuit diagram or a source code in a hardware description language (HDL) to specify how the chip will work. They can be used to implement any logical function that an application-specific integrated circuit (ASIC) could perform, but the ability to update the functionality after shipping offers advantages for many applications. FPGAs contain programmable logic components called "logic blocks", and a hierarchy of reconfigurable interconnects that allow the blocks to be "wired together"—somewhat like a one-chip programmable breadboard. Logic blocks can be configured to perform complex combinational functions, or merely simple logic gates like AND and XOR. In most FPGAs, the logic blocks also include memory elements, which may be simple flip-flops or more complete blocks of memory.

freewheel A "freewheel" or "freewheeling" diode is a diode connected in reverse diode direction in parallel with an inductive loads to help in providing a smooth current to the inductive load, eliminate negative voltage across the inductive load, and to protect a switching device from being damaged by the reverse current of the inductive load. It is normally placed in a circuit so that it does not conduct when the current is being supplied to the inductive load. When the current flow to an inductor is suddenly interrupted, the inductor tries to maintain the current by reversing polarity and increasing the voltage. Without the "freewheeling diode" the voltage can go high enough to damage the switching device (IGBT, Thyristor, etc.). With it, the reverse current is allowed to flow through the diode and dissipate.

hysteresis Hysteresis is a property of a system such that an output value is not a strict function of the corresponding input, but also incorporates some lag, delay, or history dependence, and in particular when the response for a decrease in the input variable is different from the response for an increase. Hysteresis can be used to filter signals so that the output reacts slowly by taking recent history into account. For example, a thermostat with a nominal setpoint of 75° might switch the controlled heat source on when the temperature drops below 74°, and off when it rises above 76°. Thus the on/off output of the thermostat to the heater when the temperature is between 74° and 76° depends on the history of the temperature. This prevents rapid switching on and off as the temperature drifts around the set point.

inductor An inductor (or choke) is a passive electrical component that can store energy in a magnetic field created by the electric current passing through it. An inductor's ability to store magnetic energy is measured by its inductance, in units of henries. Typically an inductor is a conducting wire shaped as a coil, the loops helping to create a strong magnetic field inside the coil due to Faraday's law of induction. Inductors are one of the basic electronic components used in electronics where current and voltage change with time, due to the ability of inductors to delay and reshape alternating currents. The effects of DC current on an inductor are described in *Application Bulletin AB*-12, *Insight into Inductor Current*, Fairchild Semiconductor, incorporated by reference herein.

laser A LASER (Light Amplification by Stimulated Emission of Radiation) is an optical source that emits photons in a coherent beam. Laser light is typically near-monochromatic, i.e. consisting of a single wavelength or hue (color), and emitted in a narrow beam. This is in contrast to common light sources, such as the incandescent or fluorescent light bulb, which emit incoherent photons in almost all directions, usually over a wide spectrum of wavelengths.

SUMMARY

It is a general object of the invention to provide an improved technique for driving current-driven loads, such as a single laser diode, or stack of laser diodes, or light emitting diodes (LEDs).

According to the invention, generally, a current driver comprises a master stage and a slave stages. Each stage ("controller" or "phase") comprises an output inductor (L1, L2) and is arranged as a buck driver. Each stage supplies half of a demanded current to a current-driven load such as LEDs or laser diodes. Ripple in the outputs of the two stages is controlled to be out-of-phase with one another.

In analog embodiments, maximum and minimum threshold currents for the ripple are sensed and used for hysteretic control of the master and slave stages (controllers). The slave controller preferentially "locks" to the anti-phase of the master stage (or phase) and the ripple current at the summed output of the two stages substantially cancels. This produces low ripple to create a driver with smaller size and simplicity.

Both stages are controlled proportionately by a demand input and act as independent hysterectic controllers with the output currents summed. The master stage runs independently and sets the frequency. The slave stage is matched and is designed to operate as closely as possible to the same frequency. The master stage output ripple (FIG. 1) or switching (FIG. 2) is phase shifted by inversion (FIG. 1), or by phase shifted by reactive components (FIG. 2), to scale and create a signal that modulates the threshold on the slave so that the slave preferentially pulls into a ripple-canceling phase. Ideally, when the output of the master stage is at a peak current, the output of the slave stage should be at a minimum current. When the two output currents are summed at the output, the peak and troughs cancel to provide a low ripple. A lower hysteretic comparator threshold on the slave stage encourages switching at the desired time, when compared to a normal threshold operation as is employed on the master stage.

In a digital embodiment, a calibration step is first performed to determine which of the two stages (phases) ramps up faster, and the faster phase is designated "master". Maximum and minimum thresholds are set, and the slave phase's on time is based on a previous cycle's slave phase ON time, the master stage OFF time and an offset.

Different output stages are illustrated for the analog and digital embodiments, but it should be understood that the choice of output stages is essentially independent of whether the current driver is based on the analog or digital embodiments.

Regarding some of the patents mentioned above, it may be noted that:

- U.S. Pat. No. 7,348,948 ('948 patent) discloses a polyphase diode driver comprising at least two driver stages. In the '948 patent, one of the driver stages is designated a "master" stage", and the other driver stages are "slave" stages.
- In the present invention, digital embodiment, the two phases are tested in a calibration step, and the one which is the fastest becomes the master phase.
- In the '948 patent, the switching devices, hence the stages, are turned ON in sequence with one another (triggered sequentially), during a "master" cycle time (Tc) that is determined by sensing current through the inductor (L1) in the master stage. In the phase controller, the cycle time (Tc) is divided by the number of stages (n), and the subsequent (slave) stages are turned ON (triggered), sequentially, at intervals of Tc/n. The outputs of all of the stages are summed.
- In the present invention, a simple cancellation is performed, rather than the summation of a plurality of pulses.
- In the present invention, there are only two stages (or phases), and the goal is to have the two stages 180 degrees out of phase. The master phase, digital embodiment, is a free-running phase whose purpose is to allow the slave phase to calculate when to switch on. The master phase is comprised of two timing parts: (1) on time and (2) off time. The slave phase controller interprets these variables and decides when to switch on the slave phase and maintain 180 degrees out of phase.
- The '948 patent is a "discontinuous" buck converter. For each pulse, current drops off to zero. In the present invention, the buck converters operate continuously", current varies between maximum (max) and minimum (min) thresholds, and the minimum threshold is above zero.

In the '948 patent, the ramp downs of the output currents of the various (n) stages are overlapping. In the present invention, overlap of output currents from the master and slave stages are sought to be avoided (see FIG. 2A).

U.S. Pat. No. 7,107,468 ('468 patent) discloses peak current-sharing in a multi-phase buck converter power system. A plurality of constant ON-time buck converters are coupled to a common load.

In the '468 patent, the purpose is to provide a regulated voltage. In the present invention, the purpose is to provide a regulated current.

The '468 patent describes constant ON-time. In the present invention, the on time of a stage (or phase) is variable, based on minimum and maximum current levels (hysteretic control).

Other objects, features and advantages of the invention may become apparent in light of the following description(s) thereof.

BRIEF DESCRIPTION OF THE DRAWINGS

The structure, operation, and advantages of the present preferred embodiment of the invention will become further apparent upon consideration of the descriptions set forth herein, taken in conjunction with the accompanying figures (FIGs). The figures (FIGs) are intended to be illustrative, not limiting. Although the invention is generally described in the context of these preferred embodiments, it should be understood that it is not intended to limit the scope of the invention to these particular embodiments.

DETAILED DESCRIPTION

Figure 1:
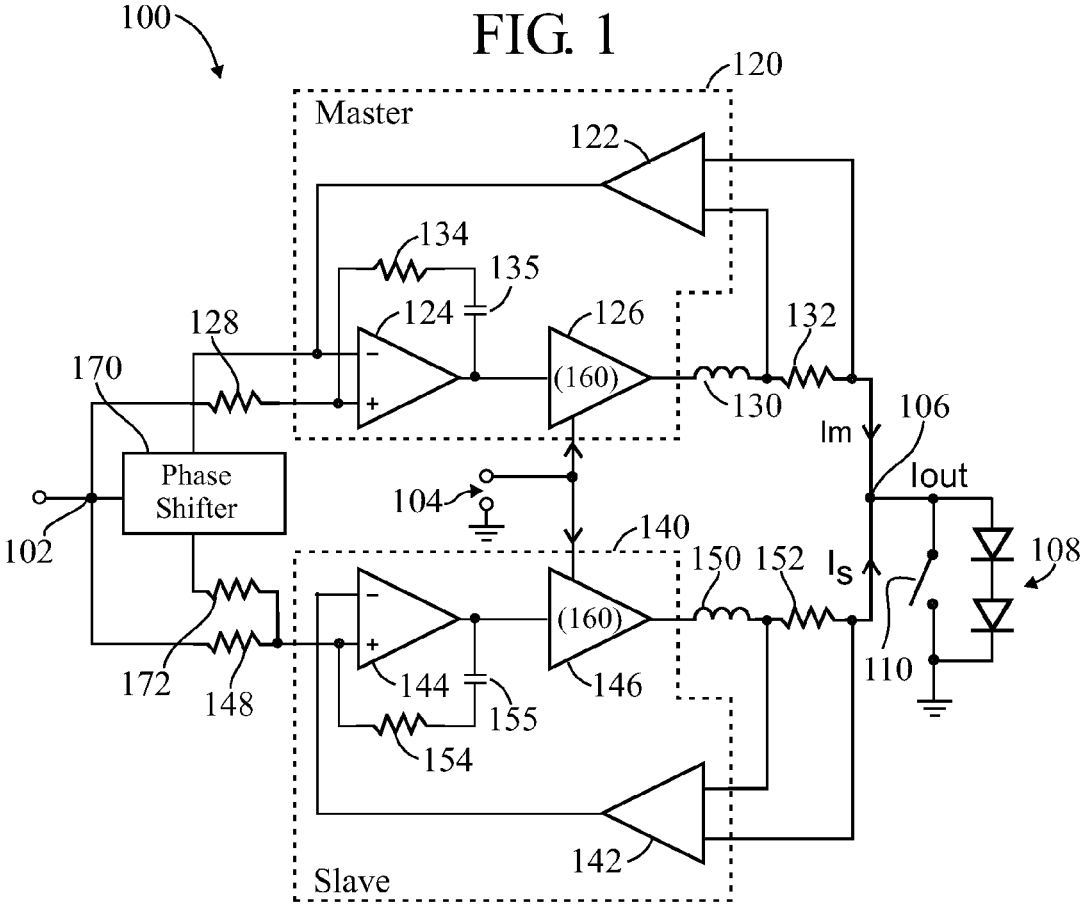
FIG. 1 is a diagram of an analog embodiment of the invention.

Various "embodiments" of the invention (or inventions) will be described. An embodiment may be an example or implementation of one or more aspects of the invention(s). Although various features of the invention(s) may be described in the context of a single embodiment, the features may also be provided separately or in any suitable combination. Conversely, although the invention(s) may be described herein in the context of separate embodiments for clarity, the invention(s) may also be implemented in a single embodiment.

Electronic components such as resistors and inductors typically have two terminals, which may be referred to herein as "ends". Other electronic components, such as comparators and amplifiers may three terminals, including two "inputs" and an "output". In some instances, "signals" may be referred to, and reference numerals may point to lines that carry said signals. In schematic diagrams, the various electronic components may be connected to one another, as shown, by lines representative of conductive lines such as wires, or traces on a printed wiring board (PWB), or conductive lines and vias in a semiconductor integrated circuit (IC) chip. When lines in a schematic diagram cross over one another, a dot at the intersection of the two lines indicates that the two lines are connected with one another, else (if there is no dot at the intersection) they are typically not connected with one another.

FIG. 1 illustrates an analog embodiment of a current driver 100. The current driver 100 generally comprises an input 102, a power supply 104, an output 106 for driving a load 108, and two controllers 120 and 140 connected between the input 102 and the output 106. The current driver 100 may be used as a laser diode driver.

In use, the input 102 receives a demand current reference voltage (signal) having a value proportional to a desired (demanded) drive current. The output 106 provides the demanded current to the load 108.

The power supply 104 may comprise a DC voltage source, such as a battery, a linear or switching power supply, a laboratory supply, a generator, or the like. The power supply 104 operates at a given voltage, and provides current for driving the current-driven load 108. Power from the power supply 104 is provided, equally, to both of the two controllers 120 and 140.

The load 108 may comprise a current-driven device, where it is desired to control the current applied to device. The load 108 may comprise, for example, a single laser diode, or stack of laser diodes, or light emitting diodes (LEDs). Other devices which may be driven by the current driver 100 may include electrodes stimulating a chemical reaction where the current needs to be regulated, and current driven thermoelectric cooler (Peltier) junctions. In the example of FIG. 1, the load 108 is shown comprising a stack of two diodes connected between the output 106 and ground.

The load 108 will typically exhibit a "diode equation" (or "diode law") characteristic, where the voltage increases slightly as current is increased. Diodes are unsuitable for driving with a voltage source as the diode equation shows that the current can change a lot for a small change in voltage; also the diode voltage typically has a negative temperature coefficient, so that the current would vary as a function of temperature.

In an LED or laser diode, the light output is a function of the current flowing in the device, and can be controlled by controlling the current supplied to (and flowing through) the device. As described in greater detail hereinbelow, the desired output current is set, as sensed by current sensing means, and the driver regulates this value. (Even if the output were shorted, the selected regulated current would flow through the shorting wire.)

The current driver 100 generally comprises two controllers (or stages, or phases, or phase drives, or channels), which are driven out-of-phase with one another. The driver 100 may thus be referred to as a "biphase" current driver. One controller (stage) 120 may function as a "master", and the other controller (stage) 140 may function as a "slave", as described below.

The master controller (stage) 120 comprises at least one input and an output, more particularly:

- a differential amplifier 122, having two inputs which are inputs to the master controller 120, and an output which is internal to the master controller 120;
- a comparator 124 having two inputs (+) and (−) which are inputs to the master controller 120, and an output which is internal to the master controller 120; and
- a driver 126 having an input which is internal to the master controller 120, and an output which is the output of the master controller 120, and provides an output current (Im);

The slave controller (stage) 140 comprises at least one input and an output, more particularly:

- a differential amplifier 142, having two inputs which are inputs to the slave controller 140, and an output which is internal to the slave controller 140;
- a comparator 144 having two inputs (+) and (−) which are inputs to the slave controller 140, and an output which is internal to the slave controller 140; and
- a driver 146 having an input which is internal to the slave controller 140, and an output which is the output of the slave controller 140, and provides an output current (Is)

Figure 1A:
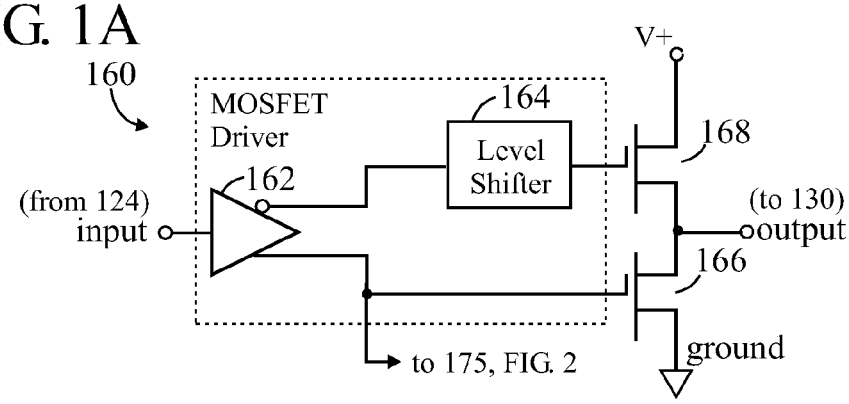
FIG. 1A is a diagram illustrating exemplary detail for a driver used in embodiments of the invention.

In FIG. 1, the drivers 126 and 146 are shown simplified. FIG. 1A shows a more detailed version of the drivers, which may include a MOSFET gate driver (within dashed lines) and two external switching transistors, such as NFETs.

The input 102 of the current driver 100 (demand current reference voltage signal) is connected via a resistor 128 to the (+) "demand" input of the comparator 124 which is one of the inputs of the master controller 120, and is connected via a resistor 148 to the (+) "demand" input of the comparator 144 which is one of the inputs of the slave controller 140.

The outputs of the differential amplifiers 122 and 142 are connected to the (−) "feedback" inputs of the comparators 124 and 144, respectively. The inputs of the differential amplifiers 122 and 142 receive a signal proportional to the output currents Im and Is of the master and slave controllers. as discussed below. The purpose of the differential amplifiers 122 and 142 is to minimize the losses in the sense resistors 132 and 152 by amplifying a low voltage drop, and referencing the amplified sense voltage to the ground to which the input 102 is referenced.

The "phase drive signal" outputs of the comparators 124 and 144 are connected to the inputs of the drivers 126 and 146, respectively. The drivers 126 and 146 take the outputs of the comparators 124 and 144 (or the gate array in a digital embodiment described hereinbelow) and make them a low impedance and of suitable voltage to directly drive a power switching devices, such as FETs (see FIG. 1A). An example of a FET driver would be the Linear Technology LTC4442 "MOSFET Driver" which is designed to drive two external N-channel MOSFETs. The FETs form a totem pole, included in driver 126, that connects inductor 130 alternately to the power source 104 or ground as commanded by the input level from the comparator.

FIG. 1A illustrates a FET driver 160, such as may be used within each of the drivers 126 and 146, comprising an input, an amplifier 162 providing a 2-phase output, and a level shifter 164. The non-inverting output drives a low side FET 166 and the inverting output drives a high side FET 168 to form a totem pole. The source of FET 168 is connected to the drain of FET 166 to connect to form the output node. The driver 160 is connected to a DC voltage source (V+) such as the power supply 104, and to ground. The phase drive signal output of the comparator (124 or 144) is provided as an input to the driver 160, which causes the output of the drivers 126 and 146 to switch between supply (V+) and ground.

The input to the driver 160 is typically a TTL or CMOS logic pulse train. The FET gate driver 160 provides a low impedance signal to drive the "lower" power transistor 166, typically a FET. Power transistor 168, typically an FET, is driven from an inverted pulse train signal. It is preferable to use a N-type enhancement FET for the lowest losses, so the level shifter 164 is used to ensure that the "upper" transistor 168 is turned on. Those skilled in the art will be aware of many methods to accomplish this, for example by bootstrapping the drive signal from the output, by capacitor coupling to a higher voltage level, by voltage level shifting by a zener or other means using a voltage source higher than the output high state, or by transformer coupling to mention a few. Special integrated circuits such as the Linear Technology LTC4442 are designed for this gate driver purpose, combining a gate driver and a level shifter, in one "package" 160. See *Datasheet, Linear Technology, High Speed Synchronous N-Channel MOSFET Drivers, LTC*4442/*LTC*4442-1, incorporated by reference herein. The LTC4442 would be the part within the dashed line.

A flyback diode (not shown) could optionally be connected across the lower NFET 166, as shown in U.S. Pat. No. 7,107, 468, described hereinabove. However, N-channel FETs have a body diode inside, and you do not really need an external one. The '468 patent includes one (115) to have more control, a faster diode, to help the node voltage between the two FETs, so that it doesn't ring negative. The diode (115) is connected across the lower FET (116), to clamp to it to ground. The upper FET (118), connected to Vin, does the driving. Typically a FET has lower conduction losses than a diode when in the (synchronous) turned-on state.

An inductor (or choke) 130 having two terminals (ends) is connected to the output of the driver 126, between the output of the master controller 120 and the output 106 of the current driver 100. Similarly, an inductor (or choke) 150 having two terminals (ends) is connected to the output of the driver 146, between the output of the master controller 140 and the output 106 of the current driver 100. Both inductors 130 and 150 are shown as and are considered as being external to their respective controllers 120 and 140. The drivers 126 and 146 switch the inductors' input ends to the input voltage 104 or ground. The inductor's output (load) ends are connected to the output 106 of the current driver 100.

The output currents (Im and Is) from the two drivers 126 and 146 flow through the inductors 130 and 150, respectively, and are summed and are provided to the load 108 to provide a substantially ripple-free driving current (Iout) for the load 108.

As will become evident from the discussion that follows, since the inductors 130 and 150 are performing similar functions as one another, it is recommended that they be "matched" (substantially identical to each other) to get the best ripple cancellation. If they were not matched, then the rate of rise and fall of current will be different, resulting in a more difficult cancellation of ripple (hence, more complexity), and likely more ripple.

As is known, the current through an inductor changes according to $V=L(dI/dt)$, where "V" is voltage, "L" is inductance, and "I" is current. Generally, when the voltage across the inductor is positive ("rising"), the current increases. And, when the voltage across the inductor is negative ("falling,"), the current decreases. The maximum current that the inductor ever sees consists of the DC current (Idc) plus half of the peak-to-peak current (Ipp) due to the switching. This latter is called the ripple current. See, *Application Bulletin AB*-12, *Insight into Inductor Current*, Fairchild Semiconductor, incorporated by reference herein.

The output currents (Im and Is) of the master and slave controllers 120 and 140 (namely, of the respective power drivers 126 and 146 through the respective inductors 130 and 150), to the load 108, may be detected by suitable current sensing means 132 and 152, respectively, such as a resistor, Hall effect sensor, current transformer or the like. The resistors need a suitable differential amplifier such as the MAX4376 (Maxim Integrated Products, Dallas Semiconductor), which are "current-sense" amplifiers that are specially designed for this type of application. The current sensing means 132 and 152 are shown as resistors ("sense" resistors) connected between the output (load) ends of the inductors 130 and 150 and the output 106 of the current driver 100 (i.e., the load 108), rather than between the drivers 126 and 146 and the input ends of the inductors 130 and 150. This is preferred because the driver, or switched input ends of the inductors 130 and 150 may be very noisy and result in erroneous signals if the common-mode rejection of the differential amplifiers 122 and 142 were not ideal. The output load voltage is fairly steady which eases the specification requirements of the differential amplifiers when the load ends of the inductors are sensed. The Hall effect sensor and transformer are already isolated from the output DC level and would typically require only scaling by amplification for the comparator to compare the feedback current value to the demand 102.

The sensed output currents Im and Is are used as feedback information to control the output load current of the overall driver 100 using the "closed loop" master and slave controllers 120 and 140. In this manner, currents flowing through the inductors 130 and 150 are continually monitored, and max and min values (thresholds) can be detected.

The output of the differential amplifier 122 of the master controller 120 is provided to the input of a phase shifter 170 (as well as to the (−) input of the comparator 124). The output of the phase shifter 170 is connected, via a resistor 172, to the (−) input of the comparator 144. In this embodiment, the phase shifter 170 is "looking at" the drive signal (output of the master controller differential amplifier 122).

The purpose of the phase shifter 170 is to cause (force) ripple in the outputs of the two controllers 120 and 140 to be out-of-phase with one another. In other words, the slave controller 140 is caused (forced) to operate with its ripple out of phase with the master controller 120.

Both stages 120 and 140 are controlled proportionately by the demand input 102 and act as independent hysterectic controllers with the output currents summed at output node 106. The master stage 120 runs independently and sets the frequency. The slave stage 140 is matched (constructed substantially identically to the master stage 120) and is designed to operate as closely as possible to the same frequency as the master stage 120.

In the FIG. 1 embodiment, the master stage 140 output ripple is phase shifted by inversion, to scale and create a signal that modulates the threshold on the slave stage 140 so that the slave stage 140 preferentially pulls into a ripple-canceling phase. Ideally, when the output of the master stage 120 is at a peak current, the output of the slave stage 140 should be at a minimum current. When the two output currents are summed at the output, the peak and troughs cancel to provide a low ripple. A lower hysteretic comparator threshold on the slave stage 140 encourages switching at the desired time, when compared to a normal threshold operation as is employed on the master stage 120.

Figure 1B:
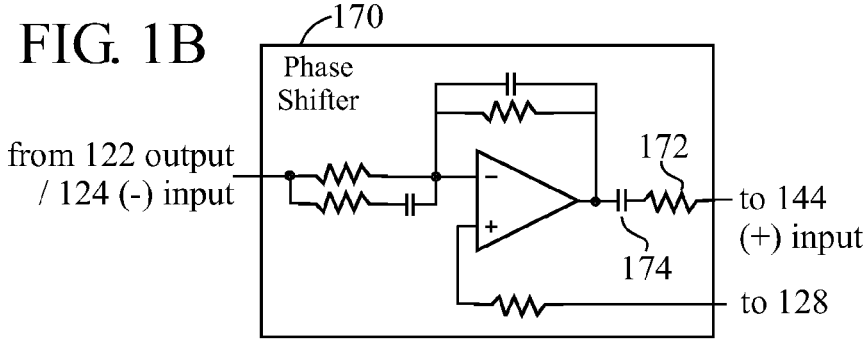
FIG. 1B is a diagram illustrating exemplary detail for a phase shifter used in the embodiment of FIG. 1.

As shown in FIG. 1B, the phase shifter 170 may comprise an inverting amplifier (such as an operational amplifier with surrounding resistors, connected in a negative-feedback configuration), is AC-coupled from the master controller 120 to the slave controller 140 (see capacitor 174), and is used to modulate the demand reference of the slave controller 140. The inverted ripple component feedback (from differential amplifier 122) input of the master controller 120 modulates (is "forced onto") the demand input (102) of the slave controller 140. In other words, the phase shifter 170 provides an inverted scaled version of the ac component of a signal from the (−) feedback input of the master stage comparator 124 onto the (+) demand input of the slave stage comparator 144. The resistor 172 acts with resistor 148 to sum, or modulate the demand level with the phase shifter 170 output to modify the switching threshold of the slave comparator 144 to favor switching operation at the desired anti-phase time.

In this embodiment, ripple in the master stage output is phase shifted by inversion, to scale and create a signal that modulates a threshold on the slave stage so that the slave stage preferentially pulls into a ripple-canceling phase.

The connection of the phase shifter 170 to resistor 128 (input 102) simply provides a "housekeeping" DC bias, typically valued at the input voltage 102, for the positive input of the inverting stage to keep the operational amplifier biased within its linear output range. Any DC offsets are removed by the capacitor 174.

In this manner, the slave controller 140 preferentially "locks" to the anti-phase of the master controller 120, and the ripple current at the summed output 106 substantially cancels. This cancellation may only be perfect at 180 degrees phase shift of the slave controller 140, and equal current rise and fall times, but even with imperfect parameters, the ripple may be substantially reduced.

The two controllers 120 and 140 each function as hysteretic controllers. A "hysteresis" (feedforward) resistor 134 is connected from the output of the comparator 124 to the (+) input of the comparator 124. A "hysteresis" (feedforward) resistor 154 is connected from the output of the comparator 144 to the (+) input of the comparator 144. In this application, hysteresis is used as positive feedback around the switching comparator (124, 144) so as to latch the output preventing fast oscillations, and to modify the threshold to set a new value.

The master stage current signal (output of differential amplifier 122) is inverted by phase shifter 170, then ac-coupled onto the slave stage demand. In the circuit, a capacitor, blocking DC feedback, is connected in series with each of the feedforward resistors 134 and 154. These capacitors 135 and 155 are shown (for illustrative clarity) connected in front of (before) the respective feedback resistor 134 and 154, but they could be connected after (on the other side of) the respective resistor 134 and 154. In this manner, the phase-shifted signal to the slave comparator is AC ripple only since if it included DC it would affect the DC average output current in the wrong sense.

The resistors 128 and 134 work together to control the hysteresis in the master controller 120, by creating maximum ("max") and minimum ("min") thresholds. The resistors 148 and 154 work together to control the hysteresis in the slave controller 140 by creating maximum ("max") and minimum ("min") thresholds. The master controller 120 establishes a frequency of operation for the current driver 100.

The outputs of the differential amplifiers 122 and 142 are compared against the demanded current reference voltage at the input 102 by respective comparators 124 and 144, with some hysteresis, to turn the drivers 126 and 146 on and off. These drivers 126 and 146, which are essentially power-switching transistors (see FIG. 1A), selectively connect the input (opposite the load) ends of the respective inductors 130 and 150 to either power 104 or ground as commanded by the comparators 124 and 144.

The demand signal (from 102) is provided to the (+) inputs of the comparators 124 and 144. The outputs (signals) from the differential amplifiers 122 and 142 are provided to the (−) inputs of the comparators 124 and 144, respectively. When the output of the differential amplifiers 122 and 142 is lower than the demand, then the outputs of the drivers 126 and 146 is commanded high (power) and current builds up in the inductors 130 and 150. When the comparator threshold is reached, the drivers 126 and 146 switch rapidly to ground, and current starts to fall in the inductors 130 and 150. Peak current is used to trip the threshold at the upper limit. The process continues, and the amount of ripple set by each controller stage 120 and 140 can be set by the value of comparator hysteresis and/or any loop delays. Hence, the controllers 120 and 140 are referred to as "hysteretic" controllers.

The master controller 120 sets the frequency of operation, generally by the amount of hysteresis, peak current, value of inductor, and any delays in the loop feeding back to the differential amplifiers 122 and 142. This frequency may (for example) be in the range of hundreds of kilohertz (KHz).

As is known, a hysteretic controller can drive 100% duty factor during the risetime of the current to obtain the fastest risetime possible with the power voltage and inductor used. Reference is made to *Designing With Hysteretic Current-Mode Control*, by Levin and O'Malley, Cherry Semiconductor Corp., 1994, incorporated by reference herein.

Figure 1C:
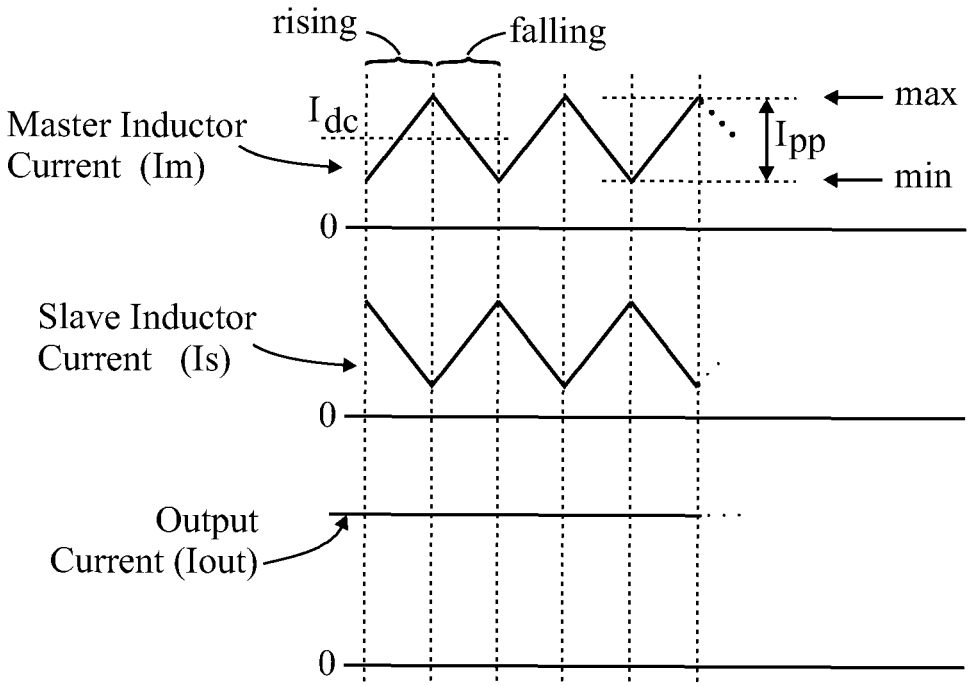
FIG. 1C is a diagram illustrating the operation of an embodiment of the invention.

FIG. 1C illustrates currents flowing through the inductors 130 and 150. Each controller stage 120 and 140 may be scaled to provide half the current demanded (Iout/2). Ramp up (rising current in the inductor) depends on input power, value of inductance. When current reaches a peak threshold ("max"), it is stopped by the comparator (124, 144). Then the driver (126, 146) goes low. Current continues to circulate in the inductor, and ramps down (falling current in the inductor) until it reaches another threshold ("min"), set in the comparator (124, 144). The demand (from 102) sets the voltage you would like to be at. When the comparator (124, 144) switches, it latches, with hysteresis, positive feedback. Small hysteresis results in higher frequency, less ripple. Larger hysteresis results in lower frequency, more ripple. (Ripple is the rising and falling of a stage's output current between max and min thresholds.)

It may be beneficial to set the output voltage (load voltage) of each of the master and slave controllers 120 and 140 to approximately half of the power supply voltage (104). Under such conditions, the rising and falling ramps for current through the inductors 130 and 150 should be of substantially equal time, and this may provide minimum losses (avoiding higher frequency ramps with associated skin effect and inductor core losses) and may allow for a substantial cancellation of ripple, as described hereinbelow.

Generally, when the voltage required by the load is approximately half of the input-power voltage, the duty cycle will be equal. If the load voltage is lower than half (of the supply voltage), the inductors will ramp up more quickly. If the load voltage were higher than half, they would ramp up more slowly (the voltage across inductor is less). Similarly the decaying inductor current (driver output low) lasts for a longer time when the output load voltage is low, and vice-versa. It is therefore harder to achieve complete ripple cancellation when the output load voltage is not half of the power input voltage.

It may be desirable in some applications to minimize the size and weight of the overall driver 100, and this may require (i) low value inductors 130 and 150 and (ii) a high switching frequency (such as 100's of KHz). The maximum switching frequency may be determined primarily by the acceptable switching losses in the output transistors (156, 158). Larger inductors 130 and 150 may be used to reduce the ripple amount, but if the ripple can be completely or partly cancelled as shown in FIG. 1C, then smaller, lighter inductors may be used to meet the ripple specifications.

AN EXAMPLE

Some exemplary components for implementing the embodiment in FIG. 1 may be:

- Diff Amps 122 and 144=Maxim MAX4376
- Comparators 124 and 144=National Semiconductor LMV7219
- Feedforward resistors 134 and 154=5.76K Ω, 1/16 W, 1%
- The phase shifter 170=Op Amp inverter (such as Maxim MAX4231) with surrounding components (resistors and capacitors), as shown in FIG. 1B
- The resistor 172=200 Ω, 1/16 W, 1%
- Drivers 126 and 146=Linear Technologies LTC4442
- Inductors 130 and 150=CoilCraft SER2814H, 4.7 μH
- Load 108=0 to 2.5V laser diode stack
- Shunt switch 110=International Rectifier IRF2804
- Output current (Iout=Im+Is)=(maximum) 50 A=25 A+25 A
  (minimum) 15 A=7.5 A+7.5 A
- Frequency=100 to 300 kHz
- Ripple=3.6 Ap-p Load Short Option U.S. Pat. No. 6,697,402, incorporated by reference herein, discloses high-power pulsed laser diode driver having a shunt switch (116), which may be a transistor such as a FET (field effect transistor), which is separately controlled and which is connected across the laser diode load (110) to promote fast rise time of current without waiting for inductors to charge. As disclosed therein:

> Fast rise time to high currents in a load such as a laser diode array is achieved by connecting an inductor between a power supply and an end of the diode array. A switching element, is connected between the other end of the diode array and ground. A shunt switch is connected across the diode array. When the shunt switch is opened, energy stored in the inductor is suddenly delivered to the diode array. A diode may be connected between the other end of the diode array and the input of the driver. A current monitor may be connected in series with the diode array. An overall system comprises the diode array driver(s) and at least a portion of the power supply-namely, an energy storage capacitor. A value for energy storage capacitor in the power supply may be selected to produce a maximally flat-top pulse shape. A source voltage provided by the power supply may be greater than, substantially equal to, or less than the voltage required by the diode. In use, closing the switching element and closing the shunt switch produces an initial current buildup in the inductor, and opening the shunt switch directs the current built up in the inductor into the diode array. Current flow through the diode array is terminated by subsequently closing the shunt switch. With the shunt switch closed, the switching element may be opened, which will cause the current in the inductor to recirculate within a loop comprising the closed shunt switch, the inductor and the diode connected across the series-connected diode array the coil. Periodically closing the switching element will refresh the recirculating current. Refreshing the current in the inductor for a burst, or very short lead time, may be done by turning on (closing) the switching element for a short time with the shunt switch closed, until the current sensed rises to the desired value.

In a similar manner, as shown in FIG. 1 herein, optionally, a shunt switch 110 (or "bypass transistor") may be incorporated into the current driver 100, connected across the load 108. The current may be turned on a short time prior to the required laser output drive, typically 10's of microseconds, and the regulated current will build up and flow in the shunt switch 110. The shunt switch 110, when closed, is essentially a short circuit across the load 108. The hysteretic controllers 120 and 140 are capable of maintaining and controlling the current into a short circuit or the load.

Current flows when the shunt switch 110 is closed. When the shunt switch 110 is turned off quickly (i.e., when the switch is "opened"), the flowing current is maintained by the inductors 130 and 150 and leads to a rapid risetime into the load 108, for example in the 100 ns range. This bypass transistor may also be used as a protective device by shorting out the laser diode/array when it is not in use.

An Alternate Embodiment

Figure 2A:
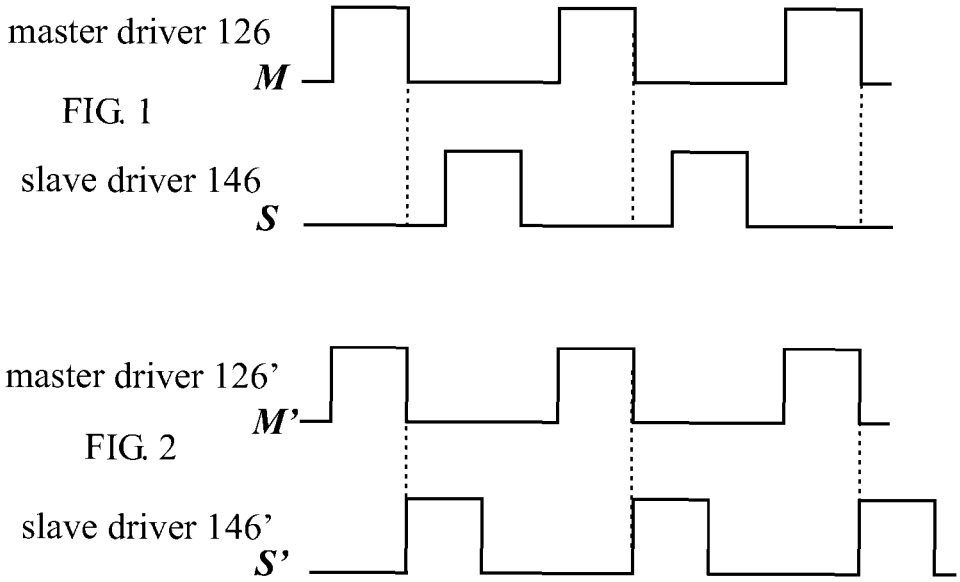
FIG. 2A is a diagram illustrating outputs of master and slave drivers for embodiments of the current drivers described herein.
Figure 2:
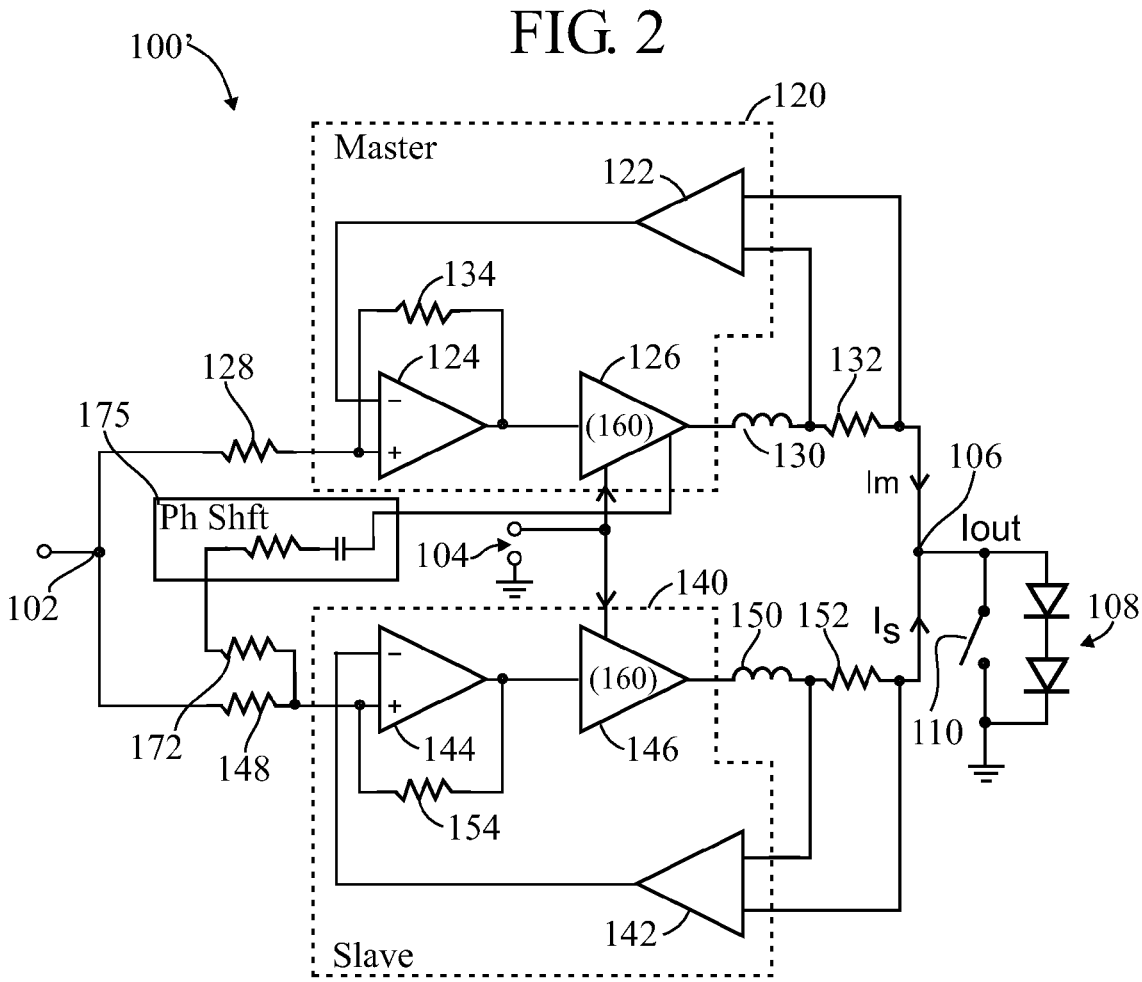
FIG. 2 is a diagram of an analog embodiment of the invention.

FIG. 2 illustrates alternate embodiment of a current driver 100' (prime). In nearly all respects, the current driver 100' may be essentially identical with the current driver 100 of FIG. 1.

In this embodiment, a phase shifter (Ps Shft) 175 is different than the phase shifter 170 of FIG. 1, and is connected differently than in the previous embodiment of FIG. 1. The phase shift of the slave controller is achieved by filtering and scaling the appropriate power transistor drive signal from the master controller to provide a modulation of the slave demand to ensure out-of-phase operation. The phase shifter 175 is connected from the output of the master driver 126 (FIG. 2A, "M") to the input of the slave driver 146. More particularly, the phase shifter 175 is connected from the line driving the lower FET 166 (see FIG. 1B) to the (+) demand input of the slave stage comparator 124.

The signal driving the lower FET 166 is a "switching signal" in the master stage which is phase shifted by reactive components in the phase shifter 175 to scale and create a signal that modulates a threshold on the slave stage 140 so that the slave stage 140 preferentially pulls into a ripple-canceling phase.

In the FIG. 2 embodiment, the master stage output switching (rather than ripple in output current) is phase shifted by reactive components (rather than by inversion) to scale and create a signal that modulates the threshold on the slave stage 140 so that the slave stage 140 preferentially pulls into a ripple-canceling phase. Ideally, when the output of the master stage 120 is at a peak current, the output of the slave stage 140 should be at a minimum current. When the two output currents are summed at the output, the peak and troughs cancel to provide a low ripple. A lower hysteretic comparator threshold on the slave stage 140 encourages switching at the desired time, when compared to a normal threshold operation as is employed on the master stage 120.

In both embodiments (FIG. 1 and FIG. 2), the phase shifter (170, 175) is connected between the two controller stages (master and slave) 120 and 140 to cause (force, ensure) the out of phase operation (namely ripple in the output current) of the slave stage 140.

In the FIG. 1 embodiment the phase shifter 170 is "looking at" the master ripple signal (ac component of the output of the master controller differential amplifier 122). In contrast thereto, in this FIG. 2 embodiment, the phase shifter 175 is "looking at" the switched output of the master controller driver 126'. This will have an impact on the timing of pulses from the slave controller 140, as discussed below with respect to FIG. 2A.

The phase shifter 175 may simply comprise a resistor connected in series with a capacitor, as illustrated. The resistor provides appropriate scaling, and the capacitor provides AC coupling. Some exemplary values for the resistor and capacitor may be: R=3.3K, C=100 pF. The resistor 172 may be incorporated within the phase shifter. The slave 140 acts as a hysteretic current driver modulated by a phase shifted signal from the master driver 120 to ensure out of phase operation and therefore ripple cancellation.

In both the FIG. 1 and FIG. 2 embodiments, embodiment, the slave stage the slave stage 140 comprises a comparator 144 at its input having a (+) demand input for receiving the signal (on input 102) indicative of the value of the demanded current with a modulation such that the ripple phase of the slave stage is opposite to a ripple phase of the master stage.

FIG. 2A illustrates the outputs of the master and slave stages for the analog embodiments of FIGS. 1 and 2, respectively. The overall goal is to minimize ripple, which can best be accomplished by causing the slave driver to turn "on" in the middle of the period when the master driver is "off".

The top two lines (M and S) show the outputs of the master driver 126 and slave driver 146 of the FIG. 1 analog embodiment. Here, the slave driver output is interleaved substantially perfectly (symmetrically) between the master pulses, creating less ripple magnitude. (This "symmetry" is also representative of the digital implementation, discussed hereinbelow.)

The bottom two lines (M' and S') show the outputs of the master driver 126 and slave driver 146 of the FIG. 2 analog embodiment. Here, the slave driver output turns "on" triggered by the master pulse, and may be "off center", which will happen when the duty cycle of the master stage is other than 50%. The solution may be simpler, but the ripple performance may not be as good as in the FIG. 1 embodiment. The values of components in the phase shifter are optimized for lowest overall ripple. (With a 50% duty cycle in the master stage, the slave stage would be substantially interleaved between master pulses.)

In any of the embodiments described herein, the output current (Iout) may be modulated or changed in amplitude by varying the demanded current voltage reference. For example, doubling the voltage reference (on 102, 102') would double the output current. Pulsing the voltage reference will pulse the output current. The output current generally follows the input voltage reference shape (with current-to-voltage scale factor). In this manner, a current driver is provided that can provide a constant, controlled, pulsed, or variable current into a current-driven device, such as a light emitting diode (LED) or array of light-emitting diodes, including laser diodes.

A Digital Implementation

Figure 3A:
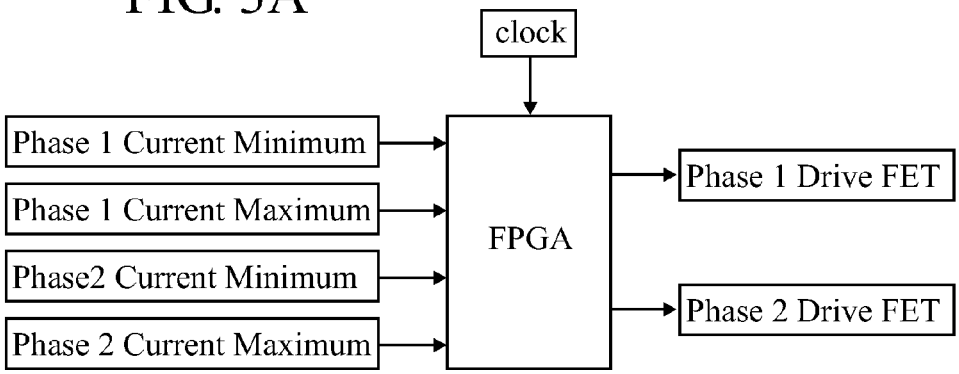
FIG. 3A is a diagram illustrating, generally, a digital implementation of the invention.
Figure 3B:
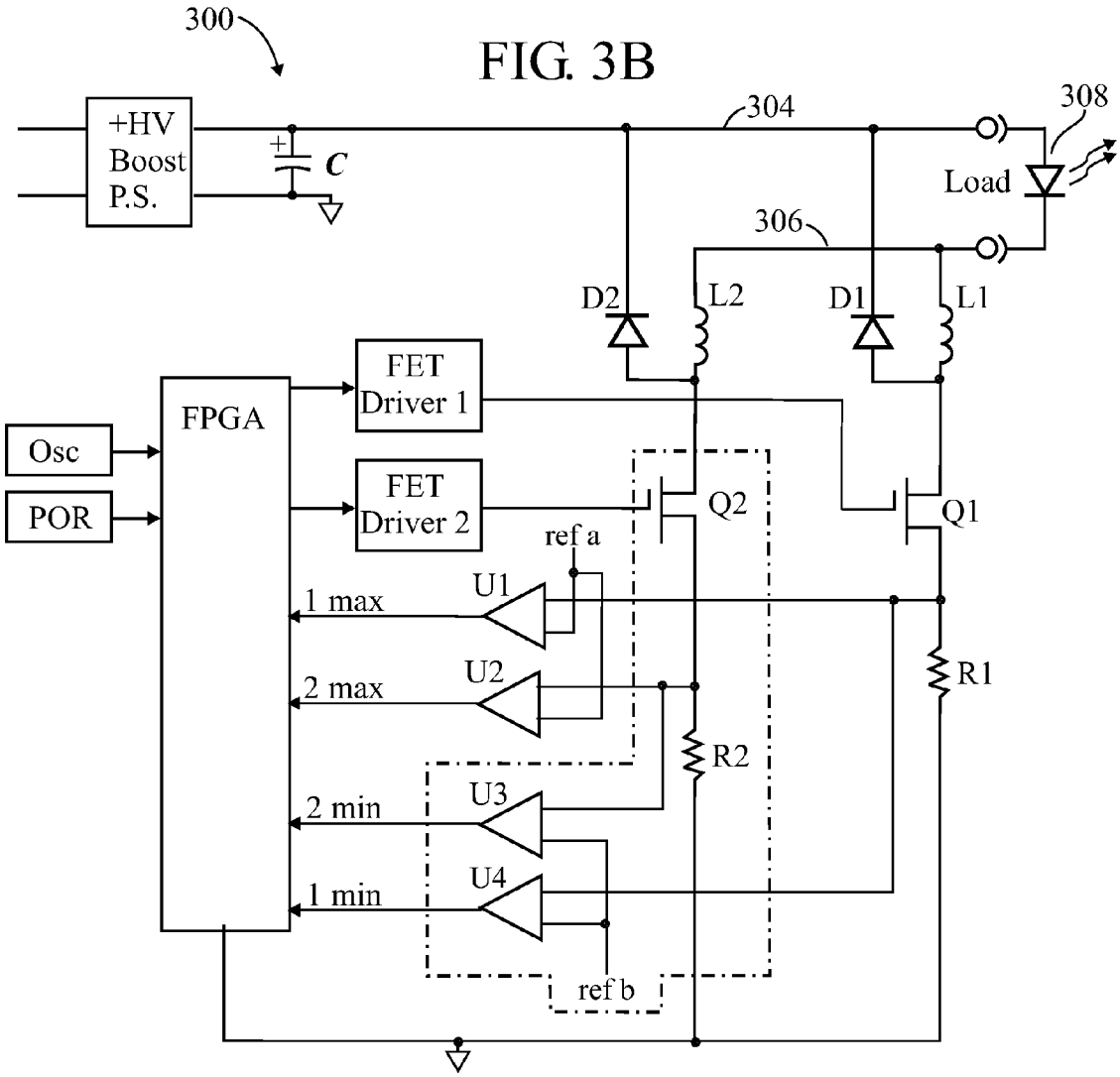
FIG. 3B is a diagram illustrating, in greater detail, a digital implementation of the invention.

FIGS. 3A and 3B illustrate a digital embodiment (implementation) of the biphase diode driver. FIG. 4 (4A and 4B) is a flowchart illustrating operation of the digital implementation.

In the digital embodiment, the current sensing, such as with sense resistors (R1, R2), and detecting max and min thresholds with comparators (U1, U2, U3, U4) is implemented similar to the analog embodiments.

In the digital embodiment, the phase shifter(s) and comparators of the analog embodiments are not needed. They are "replaced" by a high-speed digital signal processor (DSP) or field programmable gate array (FPGA). Conventional components associated with an FPGA are shown, including power on reset (POR) and clock (Osc). Clock frequency may be 50 MHz.

In the digital embodiment, the two controllers (or stages) are referred to as "phases" (since there is less hardware, and much of the "control" is in the FPGA). However, which one of the two phases will function as the "master" can be determined in a calibration step, described hereinbelow. The other controller will function as "slave". The analog "controllers" or digital "phases" may both be referred to as "stages". The master and slave "phases" may also be referred to as "drives". Both the analog and digital embodiments are "biphase", having two stages (or phases) operating out-of-phase with one another. Essentially, in both analog and digital embodiments, there are two buck regulators running in parallel.

The digital embodiment is illustrated with a different output stage than in the analog embodiments. More particularly, rather each output stage (phase) having upper and lower FETs (compare 168 and 166; FIG. 1A), in this digital embodiment each output driver phase may comprise a single FET and a diode—the diode "replacing" the upper FET (e.g., 168), and connected as flyback diodes. (Due to the exemplary configuration of the output stage, it would be more difficult to drive a FET in the upper leg.)

In the embodiments of FIG. 1 and FIG. 2, the driver 100 (100') is shown in series with the anode of the diode load to allow the convenience of a grounded cathode load. In the embodiment of FIG. 3, the driver is shown in series with the diode load cathode to allow the convenience of sensing the current with a ground reference. In the embodiment of FIG. 3, the load is floating (connected to supply voltage), rather than to ground (as in the analog embodiments). An exemplary HV boost power supply is shown, with a main capacitor for storing energy ("energy storage capacitor"). It is within the scope of the invention that the output stage could be implemented similarly to the analog embodiments, including having the load connected to ground. The output stage may be rearranged so that the comparators (U1, U2, U3, U4) could be referred to ground, rather than to the reference voltages (ref a, ref b).

The FPGA controller has two sense inputs (minimum and maximum current sense thresholds) per phase (Phase 1 and Phase 2) to properly regulate constant current:

Phase 1 Current Minimum
Phase 1 Current Maximum
Phase 2 Current Minimum
Phase 2 Current Maximum For each of the two phases (Phase 1 and Phase 2) input data, which will serve as timing information, in the form of signals indicative of current minimum (min) and current maximum (max) may be generated by the current-sensing means (sense resistors R1, R2) and comparators (U1, U2, U3, U4).

The sense inputs are interpreted algorithmically to vary switch frequency and maintain phasing. One output per phase is used to drive the phase's field effect transistor (FET):

Phase 1 Drive FET (Q1)
Phase 2 Drive FET (Q2)

To drive the FETs (Q1 and Q2), each phase is provided with a FET driver (FET Driver 1 and FET Driver 2).

In the analog embodiments resistors (such as 128/134, 148/154) are used to set the max and min thresholds, for hysteresis. In the digital embodiment, two reference voltage signals ("ref a" and "ref b") may be used, and are provided to the appropriate comparator (U1, U2, U3, U4).

In the analog embodiments, an input (102) receives a demand current reference voltage (signal) having a value proportional to a desired (demanded) drive current, and hysteresis (max and min limits) are controlled by resistors (128/134, 148/154) connected around comparators (124, 144).

In the digital embodiment, there is no comparable "input". Rather, the max and min limits (thresholds) are set, and output current is between these two limits.

It may be noted that in this exemplary digital embodiment there are two comparators used for threshold sensing in each phase:

Phase 1 uses comparator U1 for max threshold sensing, based on "ref a"
Phase 2 uses comparator U2 for max threshold sensing, based on "ref a"
Phase 2 uses comparator U3 for min threshold sensing, based on "ref b"
Phase 1 uses comparator U4 for min threshold sensing, based on "ref b"

The reference voltage signals ("ref a" and "ref b") can be calculated for minimum ripple based on load voltage, power voltage, ripple amplitude, and other parameters such as temperature by using analog-to-digital converters to input this data to the digital signal processor (DSP). An alternative could be using a look-up table for implementing the timing algorithm.

Given the somewhat "noisy" environment associated with the switching occurring in the current driver (biphase diode driver), the outputs of the comparators (U1, U2, U3, U4) may be filtered to ensure appropriate operation of the FPGA.

In FIG. 3B, the following components are interconnected as shown:

+HV Boost P.S. is a power supply, such as 55 v 3 A
C1 is an energy storage capacitor, such as 1800 μF, 63 v
FPGA, field programmable gate array for digital control, such as A3P060 (Actel)
FET Drivers 1 (and 2) is a gate driver, such as MIC4416 (Micrel)
U1, U2, U3 and U4 are comparators, such as LMV7219M7 (National Semiconductor)
the Drive FETs (Q1 and Q2) are N-FETs, such as IRF6646 (International Rectifier)
D1, D2 are high-current, high-voltage diodes, such as STPS15H100C (ST Microelectronics)
L1 and L2 are inductors (chokes), such as IHLP5050EZER4R7M01 4.7 μH (Vishay Dale)
R1 and R2 are sense resistors, such as 0.01 Ω
the load is shown as a laser diode, or array As shown in FIG. 3B, the biphase diode driver 300 (compare 100) generally comprises a power supply comprising an energy storage capacitor (C) and providing a positive voltage on a power rail 304,
an output 306 for driving a load 308, and
two stages (or phases) generally referred to as Phase 1 and Phase 2

The current driver 300 may be used as a laser diode driver, as described above.

Phase 1 comprises a driver (FET Driver 1) controlling (driving the gate of) a drive FET (Q1) in response to a signal from the FPGA. An inductor (L1) is connected by its input end to one side of Q1. A sense resistor (R1) is connected to the other side of Q1. (As used herein, "side" refers to the source or drain of the FET.) The other (output) end of the inductor L1 is connected to the output 306. The other end of the sense resistor R1 is connected back to the FPGA. A flyback diode D1 is connected from the input end of the inductor L1 to the power rail 304. Generally, the components of Phase 1 are designated with the suffix "1". Phase 1 further comprises two comparators U1 and U4, each having two inputs and one output.

When Q1 is turned "on", current ramps up and flows through the inductor L1, to the load 308, and is sensed by the sense resistor R1. When Q1 is turned "off", current through the inductor ramps down, and cannot be sensed by the sense resistor R1.

Phase 2 comprises a driver (FET Driver 2) controlling (driving the gate of) a drive FET (Q2) in response to a signal from the FPGA. An inductor (L2) is connected by its input end to one side of Q2. A sense resistor (R2) is connected to the other side of Q2. (As used herein, "side" refers to the source or drain of the FET.) The other (output) end of the inductor L2 is connected to the output 306. The other end of the sense resistor R2 is connected back to the FPGA. A flyback diode D2 is connected from the input end of the inductor L2 to the power rail 304. Generally, the components of Phase 2 are designated with the suffix "2". Phase 2 further comprises two comparators U2 and U3, each having two inputs and one output.

When Q2 is turned "on", current ramps up and flows through the inductor L2, to the load 308, and is sensed by the sense resistor R2. When Q2 is turned "off", current through the inductor ramps down, and cannot be sensed by the sense resistor R2 as it is flowing into diode D2.

Hysteresis control is provided, as follows:

- A first voltage reference signal "ref a" for setting the maximum (max) threshold for Phases 1 and 2 is provided to one of the two inputs of U1 and U2, respectively.
- A second voltage reference signal "ref b" for setting the minimum (min) threshold for Phases 1 and 2 is provided to one of the two inputs of U3 and U4, respectively. (U3 is for Phase 2, U4 is for Phase 1).
- A signal (voltage drop) representative of current flowing through the sense resistor R1 is provided to the other of the two inputs U1 and U4, for Phase 1.
- A signal (voltage drop) representative of current flowing through the sense resistor R2 is provided to the other of the two inputs U2 and U3, for Phase 2.
- The output of U1 is provided to the FPGA as a signal "1 max", for Phase 1.

The output of U2 is provided to the FPGA as a signal "2 max", for Phase 2.

The output of U3 is provided to the FPGA as a signal "1 min", for Phase 2.

The output of U4 is provided to the FPGA as a signal "1 min", for Phase 1.

Figure 4A:
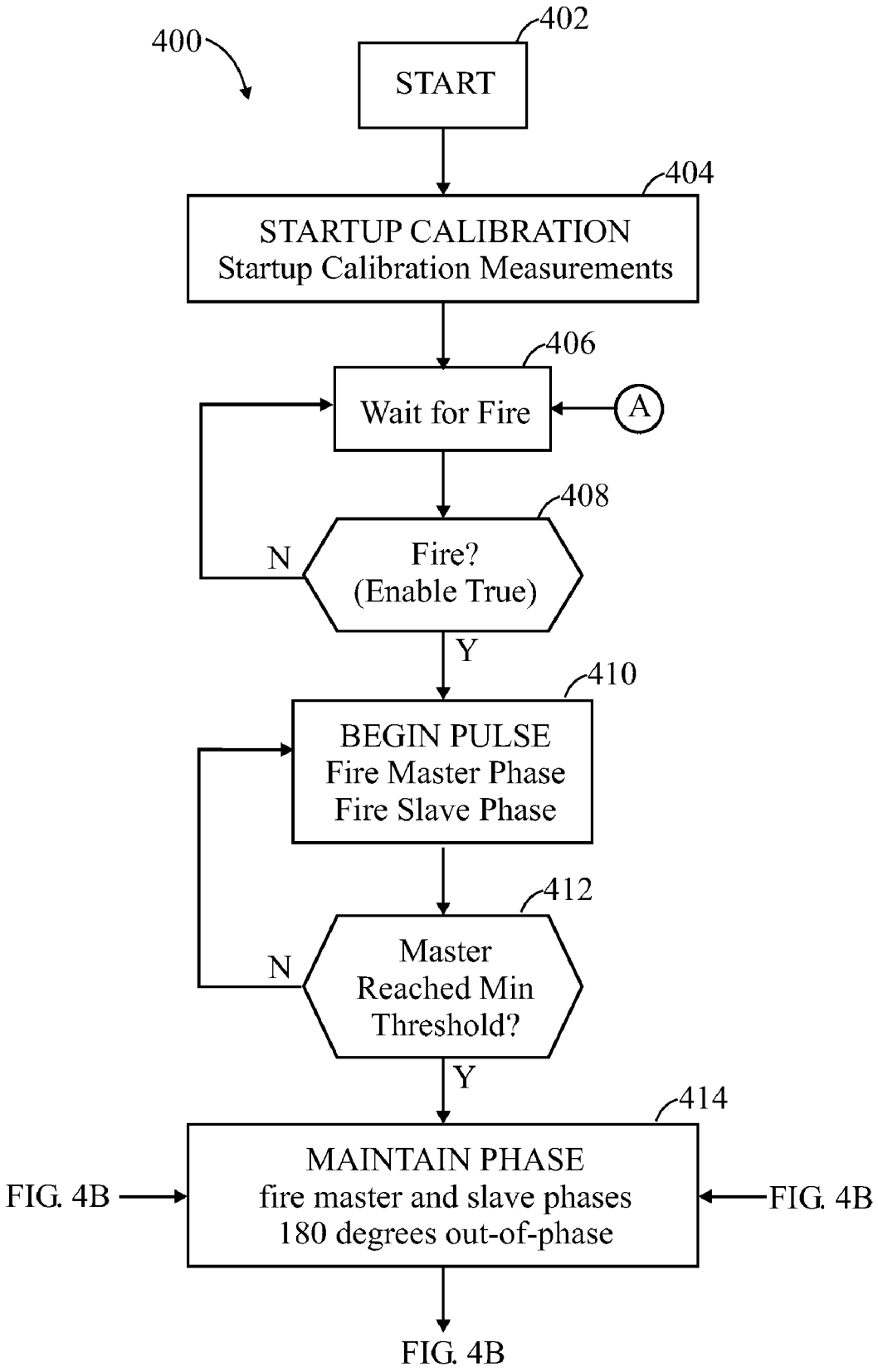
FIG. 4 (comprising FIGS. 4A, 4B) is a flowchart illustrating operation of a digital implementation of the invention.
Figure 4B:
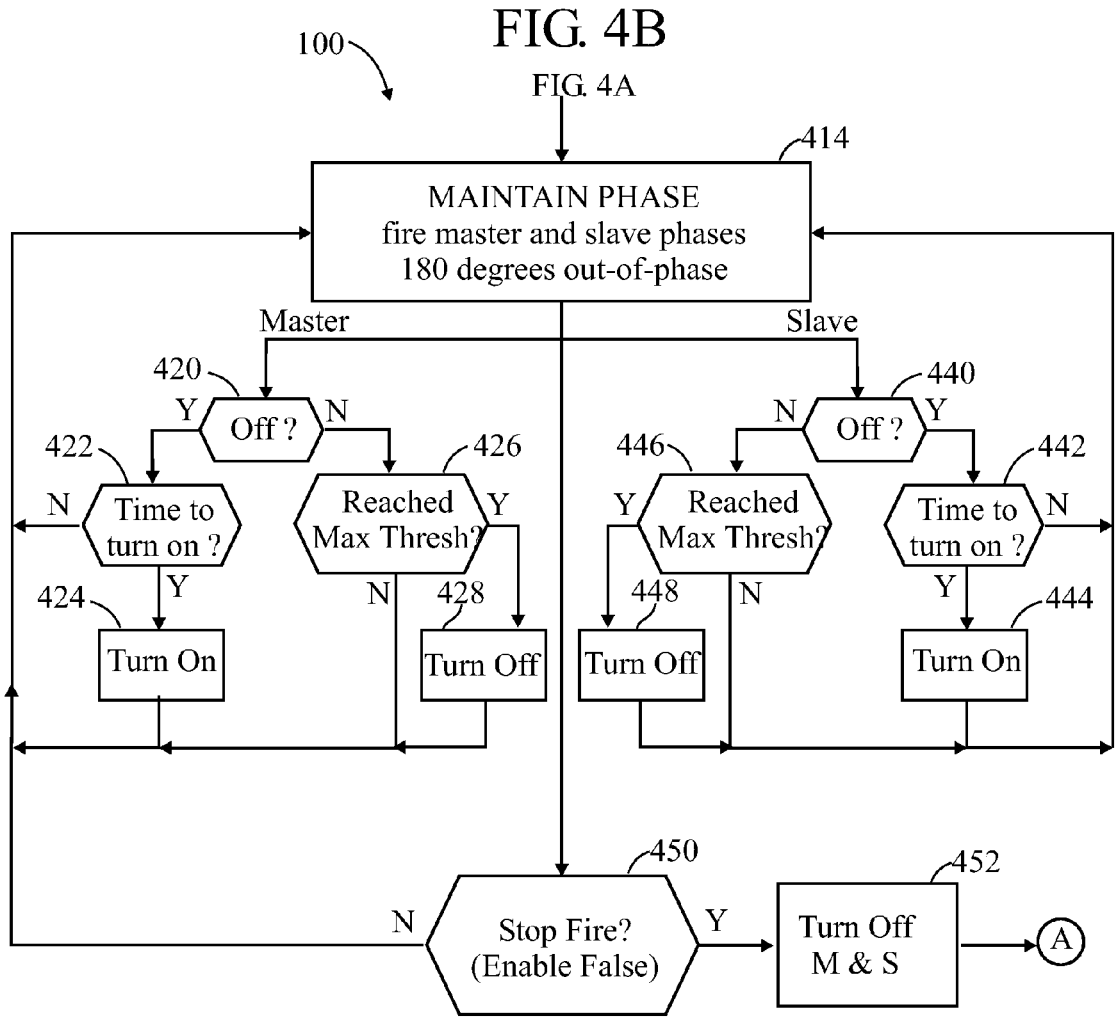

FIGS. 4A and 4B are a flowchart illustrating an exemplary method of operating the digital embodiment of the invention. Operation of two phases, one of which will become designated as (selected to be, selected to function as) the "master" phase, the other which will be the "slave" phase are described, in a series of sequential steps.

In a step 402, the flow starts. In a step 404, startup calibration is performed (startup calibration measurements are taken.)

In the analog embodiments (FIGS. 1 and 2), the selection of which stage (controller 120 or controller 140) is the master is "fixed" (predetermined, always the same), even if it ramps up more slowly than the other (slave) stage.

In the digital embodiment (FIG. 3B), during the calibration step (404) it is determined which of the two phases (Phase 1 or Phase 2) ramps up more quickly, and it is this "faster" stage that will be as the "master" phase, the other phase being the "slave" phase. A calibration pulse is performed for each phase to calculate phase "on" time, which is the elapsed time between crossing the minimum current sense threshold to reaching the maximum current sense threshold. A short test pulse is fired, and the Phases' "on" times are determined (measured). The phase with the faster (shorter) "on" time (which may result from having a lower inductance) is designated the "master" while the other phase becomes the "slave". The phases' "off" times are calculated, rather than measured, as described below.

It is, however, within the scope of the invention that a given one of the two phases, for example Phase 1, can always be the master, as in the analog embodiment. However, using the faster phase as the master phase results in less ripple in the output current as well as a higher average output current. (Conversely, if the slower phase were to be designated as master, there may be more ripple in a lower average output current.) It is also within the scope of the invention that the phases' off times could be measured (using a different output stage configuration).

Figure 5:
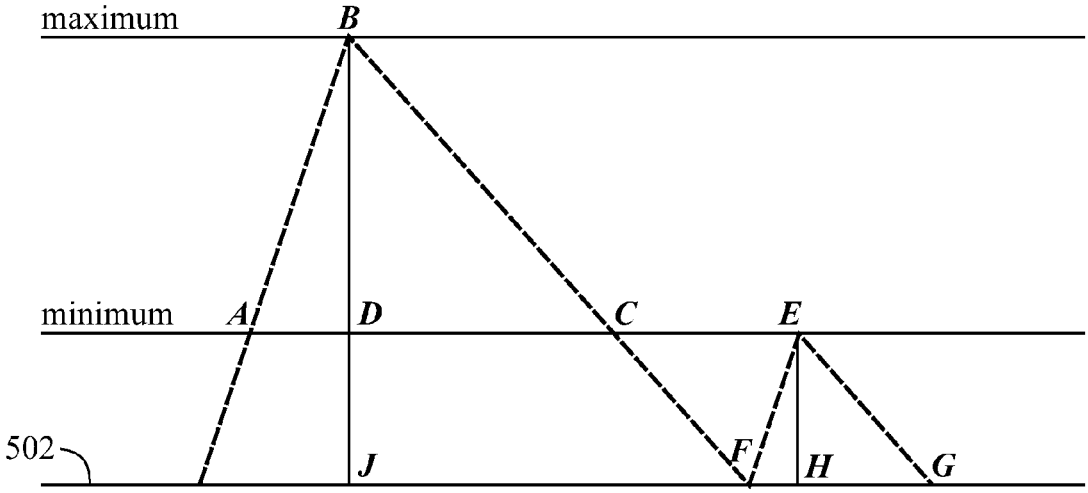
FIG. 5 is a diagram illustrating calculating one phase of the "startup" calibration pulse, according to an embodiment of the invention.
Figure 5A:
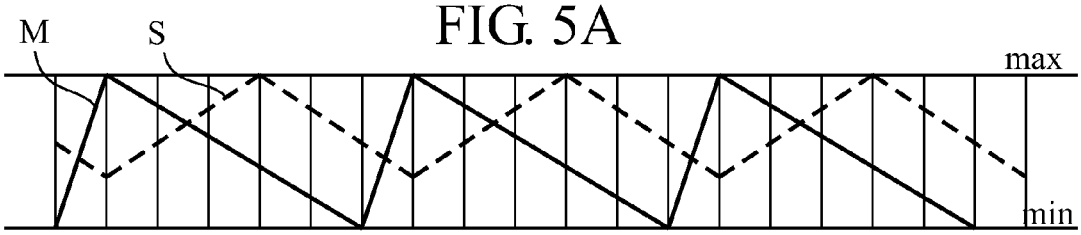
FIG. 5A is a diagram illustrating the master phase running faster than the slave phase.

FIG. 5A illustrates output currents for the master (M) and slave (S) phases, with the Master phase running faster than the slave phase, as described herein (during calibration, the faster phase is selected to be the Master phase).

Figure 5B:
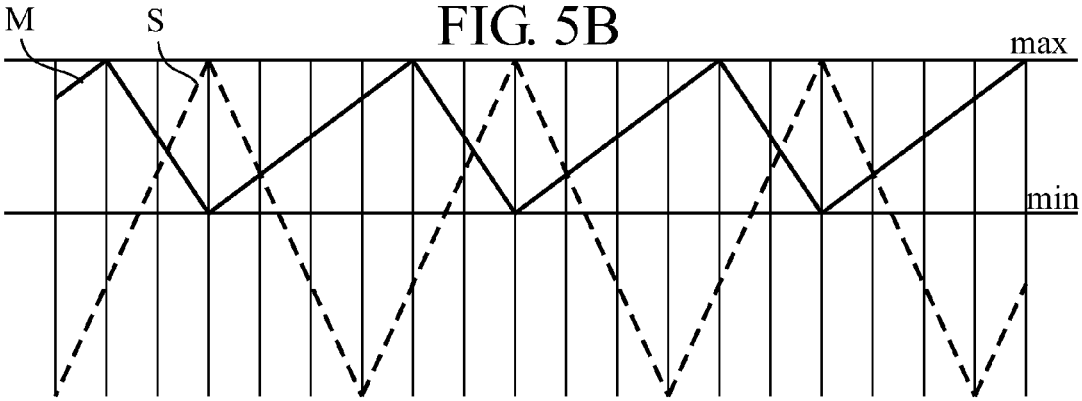
FIG. 5B is a diagram illustrating the master phase running slower than the slave phase.
Figure 6A:
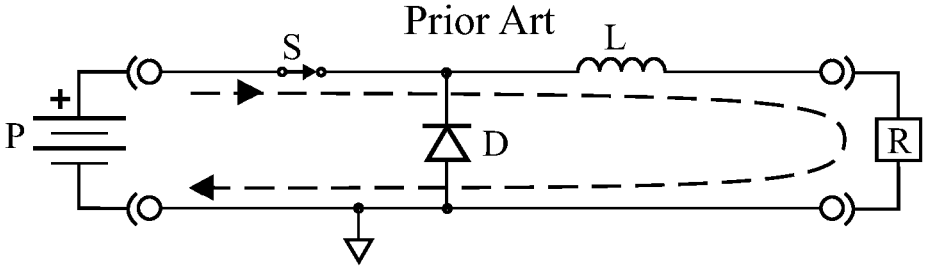
FIG. 6A Prior Art
FIGS. 6A and 6B are diagrams illustrating operation of a buck converter of the prior art.
Figure 6B:
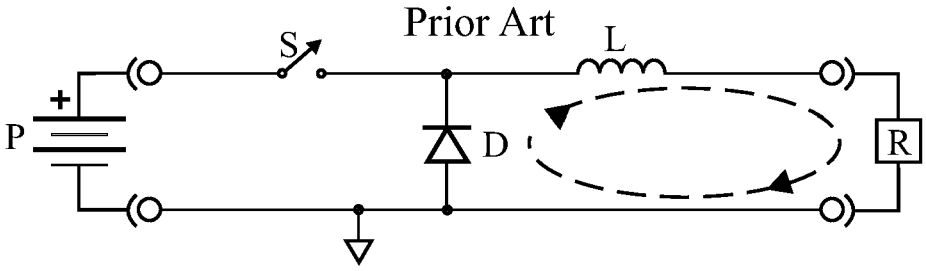
FIG. 6B Prior Art
Figure 7A:
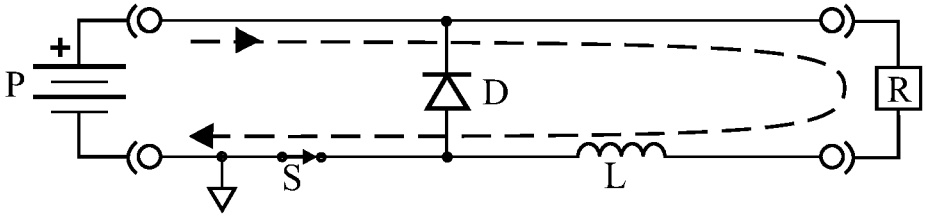
FIG. 7A Prior Art
FIGS. 7A and 7B are diagrams illustrating operation of a buck converter of the prior art.
Figure 7B:
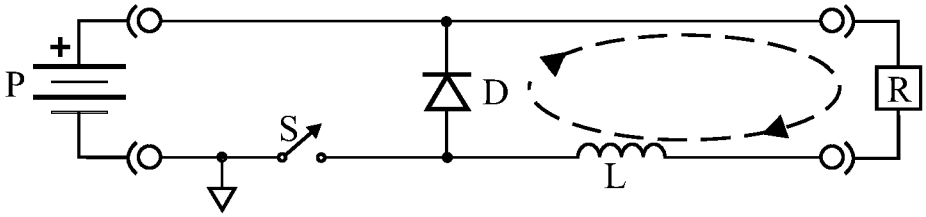
FIG. 7B Prior Art

FIG. 5B illustrates output currents for the master (M) and slave (S) phases, with the Master phase running slower than the slave phase. This is illustrative only, since the situation does not occur.

Two rules may be enforced:

- Rule 1, the Master Phase always runs between min and max thresholds
- Rule 2 never exceed max Regarding calibration (step 404), and with reference to the output stage configuration of FIG. 3B, it is evident that it is only possible to measure the current as it is ramping up in the coils L1 and L2, and it is not possible to measure the current when it is ramping down, because when Q1 and Q2 are shut off, the coils L1 and L2 are disconnected and current is no longer flowing through the sense resistors R1 and R2 for measurement. (When Q1 and Q2 are off, current continues to flow in the freewheel paths, through D1 and D2, respectively.)

Since "off" time cannot be measured (with Q1 and Q2 turned off), a calculation is used to determine (calculate) the phases' "off" time. The mathematics may be simplified by assuming the inductor current ramp up and ramp down are both linear. As a result, similar triangle properties (see FIG. 5) may be used to accurately calculate the amount of time a phase drive (Phase 1 or 2) shall remain off. ("off" time is the interval between the time the phase output reaches maximum and the phase FET is turned off, and the time that the phase FET is turned back on.)

FIG. 5 is a diagram illustrating one phase of the "startup" calibration pulse, and illustrates the mathematics of use similar triangle properties to calculate the phase "off" time. By knowing the on time, AD, amount of intentional time off, JF, or 4*AD, and time on again to reach the minimum threshold, FH, the phase off time, DC, can easily be calculated. This off time remains constant throughout the diode pulse cycle. This calculation is done for both of the phases (Phase 1 and Phase 2).

The line 502 is an arbitrary time line that ensures current has ramped down below the minimum threshold for calibration. The following points are shown A, B, C, D, E, F, G, H, J ("I" omitted, so as not to be confused with the number "1", and there is no point at the lower left of the diagram since current has not ramped up to minimum yet).

$$AD/FH=BD/EH$$

$$BD=EH*AD/FH \quad \text{Eqns. 1}$$

$$B=BD+EH$$

$$BJ=(EH*AD/FH)+EH$$

$$BJ=EH*((AD/FH)+1) \quad \text{Eqns. 2}$$

$$BD/BJ=DC/JF$$

$JF=4*AD$ (Known because calibration off time here is, in the algorithm, 4 times longer than the on time. This value is set programmatically.)

$$BD=(BJ*DC)/(4*AD)=(EH*AD)/FH$$

$$[DC*EH*((AD/FH)+1)]/(4*AD*AD)=EH/FH$$

$$DC=(4*AD*AD)/(AD+FH) \quad \text{Eqns. 3}$$

Step 406 represents a wait state, waiting for an enable signal to arrive, which will tell the driver what to do. The enable signal will initiate the pulse, and have the information about how long the ON time will be. The ON time is a stored value. The ON time may increase as the energy on the storage capacitor (C) is depleted and the duty cycle increases.

In a step 408, it is determined whether to fire (Enable True). The result is either positive (Y) or negative (N). If negative (N), keep waiting (step 406). If positive (Y), perform BEGIN PULSE (step 410).

In the step 410, when the input trigger is enabled, both phases (master and slave) are switched on (step 410) and begin delivering current to the load. This behavior continues until the minimum current sense thresholds for each phase have been reached. At that point, each phase begins following rules to maintain ideal phasing and average constant current.

The master phase continues running until the maximum threshold has been reached, while the slave phase aims to switch off directly in between the minimum and maximum current sense points.

Initially, at startup, both Master and Slave phases ramp up, from zero (below the minimum threshold (min)). When it is detected that the master phase has reached min (FIG. 5, point "A"), the master phase will continue ramping up, to max. In a startup condition, the slave phase will also continue to ramp up, but only for one half of the ON time, reaching a point between min and max, then turn off. This (current rising in both the master and slave phases) is a startup condition only.

In a step 412, it is determined whether the Master Phase has reached the minimum threshold (min). If the result is negative (N), return to step 410. When the master phase current (Im) has reached the minimum threshold (min), the result of the step 412 is positive (Y), and the driver can commence normal, biphase operation.

In a step 414 (MAINTAIN PHASE) current is provided to the load in the biphase manner, by firing first the master phase and then the slave phase, 180-degrees out-of-phase. For each cycle, master drive (phase) ON time is measured.

The current driver 300 is capable of providing a constant, controlled, pulsed, or variable current into the load. By way of example, in a pulsed application, a pulse delivered to the laser (load) may last a few hundred microseconds. The frequency of operation may be in the range of hundreds of kilohertz (KHz), and a master drive cycle may last only a few microseconds (generally, a function of pulse width, capacitor, and amount of current being delivered to load.) Hence, a single pulse may comprise hundreds of cycles. There is no need to recalibrate (step 404) for each pulse. In a constant (not pulsed) mode, inductors (L1, L2) and sense resistors (R1, R2) would need to be rated accordingly. In the main, pulsed mode operation is discussed herein.

In FIG. 4B, steps 420-428 performed with respect to the Master Phase are described, and steps 420-438 performed with respect to the Slave Phase are described.

In a step 420, it is determined whether the Master Phase is "off". The result is either positive (Y) or negative (N).

If the result of the step 420 is positive (Y), it is determined in the step 422 whether it is time to turn the Master Phase "on". If the result of the step 422 is positive (Y), in a step 424 the Master Phase is turned "on", and the program returns to the step 414 (Maintain Phase). If the result of the step 422 is negative (N), the program returns to the step 414 (Maintain Phase).

If the result of the step 420 is negative (N), it is determined in a step 426 whether the Master Phase has reached the maximum threshold. If the result of the step 426 is negative (N), the program returns to the step 414 (Maintain Phase). If the result of the step 426 is positive (Y), in a step 428 the Master Stage is turned "off", and the program returns to the step 414 (Maintain Phase).

The master phase continues to oscillate (run) unencumbered between minimum to maximum and maximum to minimum thresholds. As the capacitor's (C) stored energy depletes (reduced voltage), phase duty cycles consequently increase, and the master phase "on" time increases. The master phase's off time, calculated during startup calibration, does not increase or decrease, however the master phase's off time remains constant which forces the master phase to switch on at approximately the same current level. "On" time is dynamically updated with each master phase drive (with each cycle).

The slave phase is operated (steps 440-448) in a manner similar, but not identical to the operation (steps 420-428) of the master phase.

In a step 440, it is determined whether the Slave Phase is "off". If the result of the step 440 is positive (Y), it is determined in the step 442 whether it is time to turn the Slave Phase "on". If the result of the step 442 is positive (Y), in a step 444 the Slave Phase is turned "on", and the program returns to the step 414 (Maintain Phase). If the result of the step 442 is negative (N), the program returns to the step 414 (Maintain Phase).

If the result of the step 440 is negative (N), it is determined in a step 446 whether the Slave Phase has reached the maximum threshold. If the result of the step 446 is negative (N), the program returns to the step 414 (Maintain Phase). If the result of the step 446 is positive (Y), in a step 448 the Slave Phase is turned "off", and the program returns to the step 414 (Maintain Phase). "On" time is dynamically updated with each master phase drive (with each cycle).

Similar to the master phase, the slave phase switches off when its maximum threshold is reached. To maintain 180 degree phasing, though, the slave cannot switch off for a constant period of time. Instead, the slave "off" time, or time between slave drives, is calculated at the end of each slave drive cycle.

The goal of this calculation is to estimate when the slave should switch back on. Ideally, this point is in the middle of the master phase cycle. As the duty cycle increases beyond 50%, though, the slave must accommodate for the lack of current master phase data (the data that the slave phase is using will be based on the previous master phase cycle) and must switch on prior to the completion of the master drive cycle.

An offset calculation, again using similar triangle properties, is used to determine how far behind or ahead the slave phase is of the master phase. If the slave phase is running too slowly and not keeping pace with the master phase, the slave switches "on" an offset sooner that it would otherwise. The slave switches on an offset later in the event the slave is outpacing the master phase.

The calculation of when to turn the slave phase back on is calculated as the summation of previous cycle's slave phase ON time plus the master stage OFF time (which is a constant value determined during calibration), taking into account the offset which was calculated.

By following this methodology, the slave phase attempts to reach the maximum current sense threshold at approximately the midpoint of two consecutive master phase maximum threshold points in order to maintain 180 degree phasing.

In a step 450, if the enable signal indicates (Y) that it is time to stop (enable "false"), the pulse is finished, and the master and slave stages are turned off in a the step 452 and control returns to step 406 to initiate another firing (pulse) of the laser (waiting for another enable "true"). Else (N), the pulse is not finished, and the master and slave phases keep firing (step 414).

While the invention has been described with respect to a limited number of embodiments, these should not be construed as limitations on the scope of the invention, but rather as examples of some of the embodiments. Those skilled in the art may envision other possible variations, modifications, and implementations that are also within the scope of the invention, based on the disclosure(s) set forth herein.

What is claimed is:

1. Method of supplying a controlled current to a load comprising:

driving the load with two controller stages, one of which is a master stage, the other of which is a slave stage, each of which has an output;

causing the slave stage to operate so that ripple in the output of the slave stage is substantially out of phase with ripple in the output of the master stage;

ripple in its output out of phase with ripple in an output of the master stage; and summing output currents of the master and slave stages to drive the load;

wherein the master stage is a one of two digital phases, further comprising:

selecting which one of the two phases is the master stage based on a calibration step wherein it determined which of the two phases ramps up in current more quickly.

2. The method of claim 1, wherein causing the slave stage to operate with its ripple out of phase with the ripple in the master stage comprises:

phase shifting ripple in the master stage output by inversion, to scale and create a signal that modulates a threshold on the slave stage so that the slave stage preferentially pulls into a ripple-canceling phase.

3. The method of claim 1, wherein causing the slave stage to operate with its ripple out of phase with the ripple in the master stage comprises:

phase shifting a switching signal in the master stage by reactive components to scale and create a signal that modulates a threshold on the slave stage so that the slave stage preferentially pulls into a ripple-canceling phase.

4. The method of claim 1, further comprising:

connecting a phase shifter between the two stages to cause ripple in the slave stage to be out of phase with ripple in the master stage.

5. The method of claim 1, further comprising:

providing an inverted approximately 180 degrees phase shift version of a signal indicative of an output current of the master stage to an input of the slave stage.

6. The method of claim 1, further comprising:

calculating off times for the two phases.

7. The method of claim 1, further comprising:

switching the slave phase off when its maximum threshold is reached; anf and calculating a slave phase off time at an end of each slave drive cycle.

8. The method of claim u, wherein calculating the slave phase off time comprises:

summing a previous cycle's slave phase ON time plus the master stage OFF time taking into account an offset that was calculated.

9. The method of claim 1, further comprising:

in the calibration step, calculating an OFF time for the master stage.

10. The method of claim 9, wherein:

the master stage OFF time is a constant value determined during the calibration step.

11. A current driver for driving a load comprising:

an input for receiving a value of a demanded current;

an output for providing the demanded current to the load;

two controller stages connected between the input and the output, wherein one of the controller stages is a master stage and the other of the controller stages is a slave stage; and a phase shifter connected between the two controller stages for causing the slave stage to operate out-of-phase with the master stage;

wherein:

the master stage comprises a comparator at its input having a demand input for receiving a signal indicative of the value of the demanded current and a feedback input receiving a signal indicative of an output current of the master stage;

the slave stage comprises a comparator at its input having a demand input for receiving the signal indicative of the value of the demanded current and a feedback input receiving a signal indicative of an output current of the slave stage;

the phase shifter is connected between the feedback input of master stage and the demand input of the slave stage comparator.

12. The current driver of claim 11, wherein:

the phase shifter is connected from an output of the master stage to an input of the slave stage, the master stage comprises a FET driver in its output;

the slave stage comprises a comparator at its input having a demand input for receiving the signal indicative of the value of the demanded current and a feedback input receiving a signal indicative of an output current of the slave stage;

the phase shifter is connected between the FET driver of the master stage and the demand input of the slave stage comparator.

13. The current driver of claim 11, wherein:

the master stage comprises a hysteretic driver providing a current regulated output of half the demanded current;

the slave stage comprises a comparator at its input having a demand input for receiving the signal indicative of the value of the demanded current with a modulation such that the ripple phase is opposite to a ripple phase of the master stage.

14. The current driver of claim 11, wherein:

output currents (Im and Is) from the master and slave stages flow through master and slave stage inductors, are summed and are provided to the load to provide a substantially ripple-free driving current (Tout) for the load.

15. The current driver of claim 11, wherein:

the load comprises a current-driven device selected from the group consisting of one or more LEDs and one or more laser diodes.

16. The current driver of claim 11, wherein:

the load is connected between output of the current driver and ground.

17. The current driver of claim 11, wherein:

the load is connected between an output of the current driver and a power supply comprising a main storage capacitor.

18. The current driver of claim 11, wherein:

the current driver is capable of providing a constant, controlled, pulsed, or variable current into the load.

* * * * *